US011382404B2

(12) United States Patent
Davies

(10) Patent No.: US 11,382,404 B2
(45) Date of Patent: Jul. 12, 2022

(54) RUCKSACK FRAME

(71) Applicant: DAVIES BRETON LTD., Bury St. Edmunds (GB)

(72) Inventor: Jonathan Davies, Bury St. Edmunds (GB)

(73) Assignee: DAVIES BRETON LTD., Bury St. Edmunds (GB)

( * ) Notice: Subject to any disclaimer, the term of this patent is extended or adjusted under 35 U.S.C. 154(b) by 0 days.

(21) Appl. No.: 16/762,649

(22) PCT Filed: Nov. 7, 2018

(86) PCT No.: PCT/GB2018/053230
§ 371 (c)(1),
(2) Date: May 8, 2020

(87) PCT Pub. No.: WO2019/092419
PCT Pub. Date: May 16, 2019

(65) Prior Publication Data

US 2021/0186188 A1 Jun. 24, 2021

(30) Foreign Application Priority Data

Nov. 10, 2017 (GB) ..... 1718638
Aug. 6, 2018 (GB) ..... 1812749

(51) Int. Cl.
*A45F 4/06* (2006.01)
*A47C 13/00* (2006.01)
(Continued)

(52) U.S. Cl.
CPC ..... *A45F 4/06* (2013.01); *A47C 13/00* (2013.01); *A45F 2004/006* (2013.01); *A45F 2004/026* (2013.01)

(58) Field of Classification Search
CPC ..... A45F 4/06; A45F 2004/006; A45F 2004/026; A47C 13/00; A47C 13/002
(Continued)

(56) References Cited

U.S. PATENT DOCUMENTS 3,846,855 A * 11/1974 Peterson ..... A45F 4/06 5/114
3,933,164 A * 1/1976 Ness ..... A45F 4/06 135/95
(Continued)

FOREIGN PATENT DOCUMENTS

CN 2051064 U 1/1990
JP H11-75936 A 3/1999
JP 2001-112541 A 4/2001

OTHER PUBLICATIONS

International Search Report and Written Opinion (Application No. PCT/GB2018/053230) dated Jan. 22, 2019 (14 pages).
(Continued)

*Primary Examiner* — Adam J Waggenspack
(74) *Attorney, Agent, or Firm* — Burr & Brown, PLLC

(57) ABSTRACT

A frame for a rucksack that is convertible into a support for a person such as a chair or bed. Also, a rucksack including such a frame. A convertible frame for a rucksack comprises two main frame members connected together by a pair of extendable connectors; at least two leg members connected or connectable to the main frame members; and a flexible support attached or attachable to the main frame members to extend between the main frame members, the frame being convertible between a first configuration, in which the main frame members have a first distance between them, and a second configuration, in which the frame forms a support for a person and the main frame members have a second
(Continued)

distance between them. Also, a rucksack comprising such a frame, a bag, a rear cover and shoulder straps.

18 Claims, 10 Drawing Sheets

(51) Int. Cl.
*A45F 4/00* (2006.01)
*A45F 4/02* (2006.01)

(58) Field of Classification Search
USPC ..... 224/155
See application file for complete search history.

(56) References Cited

U.S. PATENT DOCUMENTS

| | | | | |
|---|---|---|---|---|
| 5,489,052 | A | 2/1996 | Blood | |
| 5,957,349 | A * | 9/1999 | Krulik | A45C 9/00 224/155 |
| 6,742,684 | B2 * | 6/2004 | Oh | A45C 9/00 224/153 |
| 9,936,778 | B2 * | 4/2018 | Holland | A45F 4/06 |
| 2004/0140332 | A1 | 7/2004 | Blood | |
| 2009/0084821 | A1 | 4/2009 | Lenzi | |
| 2015/0320188 | A1 | 11/2015 | Lindner | |
| 2020/0352294 | A1 * | 11/2020 | Davis | A45F 3/04 |

OTHER PUBLICATIONS

GB Search Report, GB Application No. 1812749.8, dated May 3, 2019 (2 pages).
GB Search Report, GB Application No. 1718638.8, dated May 3, 2018 (3 pages).

* cited by examiner

RUCKSACK FRAME

BACKGROUND

This invention relates to a frame for a rucksack that is convertible into a support for a person such as a chair or bed. This invention further relates to a rucksack including such a frame.

When a person goes camping it is common to carry a tent, sleeping bag and other items in a rucksack that is carried on the person's back. In order to provide a more comfortable surface on which to sleep it is known to carry a roll up foam mat that can be placed on the ground under a sleeping bag. These mats are generally light weight. However, they are relatively bulky and either occupy a large portion of the internal space of a rucksack or have to be strapped to the outside of the rucksack. Furthermore, due to the limited weight of the camping mat and the placement of the mat directly on the ground or on a groundsheet, they only offer limited comfort.

Improved comfort may be provided by a camp bed which comprises a flexible support suspended from a frame. The frame is raised off the ground and supported on a plurality of legs. Because a person lying on the camp bed is raised off the ground, the camp bed provides improved comfort over a camping mat. A camp bed is, however, significantly heavier and larger than a camping mat. A camp bed is, therefore, not suitable for carrying in a rucksack. In particular, the dimensions of a camp bed, even when folded, make the camp bed awkward to carry as the camp bed is significantly wider than a traditional rucksack.

In other circumstances it is known to carry a foldable chair or sun lounger to an outdoor leisure site such as a picnic area or a beach. The chair or sun lounger will typically fold into a relatively flat configuration for transportation and storage. As with the camp bed, even in this folded configuration the chair or sun lounger is relatively bulky with relatively large dimensions. Accordingly, the chair or sun lounger is often simply carried in a person's hand or under their arm, rather than being carried in a bag. It is known to provide a strap to enable a person to carry the chair over their shoulder; however, the chair is still awkward to carry.

It is an object of the present invention to provide a support for a person, such as a chair or bed, that is more easily transported to a place of use.

SUMMARY OF THE INVENTION

According to a first aspect of the present invention there is provided a convertible frame for a rucksack, the frame being convertible into a support for a person and comprising:

- two main frame members connected together by a pair of extendable connectors;
- at least two leg members connected or connectable to the main frame members; and
- a flexible support attached or attachable to the main frame members to extend between the main frame members,
- the frame being convertible between a first configuration, in which the main frame members have a first distance between them and the first distance defines a width of the rucksack, and a second configuration, in which the main frame members have a second distance between them and in which the main frame members are supported in a raised position by the leg members, and in the second configuration the main frame members suspend the flexible support for supporting the weight of a person when the main frame members are in the raised position, and wherein the second distance is larger than the first distance.

The first distance is preferably between 400 mm and 500 mm, and more preferably the first distance is about 450 mm. The second distance is preferably between 600 mm and 700 mm, and more preferably the second distance is about 620 mm.

In preferred embodiments the two main frame members extend parallel to each other.

Preferably each of the leg members is substantially U-shaped and comprises a base portion and two side portions. The base portion of each leg member may comprise one of the pair of extendable connectors. Each of the extendable connectors preferably comprises a pair of telescopic tubes and a sleeve surrounding a connection between said tubes.

In preferred embodiments each of the extendable connectors comprises a pair of members that are slidably engaged with each other. Each of the extendable connectors may comprise a pair of telescopic tubular members.

Preferably the leg members are connected to the main frame members and an angle between each of the leg members and the main frame members is fixed.

The support for a person may be in the form of a chair or bed. The flexible support may comprise a sheet of fabric. In other embodiments the flexible support may comprise a polymeric sheet. In further embodiments the flexible support comprises a plurality of flexible strips.

In some embodiments the convertible frame further comprises a latching mechanism configured to latch the convertible frame in the second configuration. The convertible frame may comprise a latching mechanism configured to latch the convertible frame in the first configuration. The latching mechanism preferably comprises a pin receivable in a hole or slot. The or each latching mechanism may comprise a retractable pin receivable in a hole or one of a plurality of holes. In embodiments in which the extendable connectors comprise a pair of members that are slidably engaged with each other, the retractable pin is preferably connected to a first one of the pair of members and the hole or the plurality of holes is preferably provided in a second one of the pair of members.

In some embodiments the convertible frame further comprises a foot frame connected or connectable to a first end of each of the main frame members, the foot frame comprising a pair of side frame members and a pair of legs, and the legs supporting the side frame members in a raised position when the convertible frame is in the second configuration. Each of the legs is preferably pivotally connected to a respective one of the side frame members. The side frame members of the foot frame may be pivotally connected to the main frame members.

In some embodiments the convertible frame further comprises a back frame connected or connectable to a second end of each of the main frame members, the back frame comprising a pair of side frame members and a pair of struts, and the struts supporting the side frame members at an angle to the main frame members when the convertible frame is in the second configuration. Each of the struts preferably extends between one of the side frame members and a leg member of the convertible frame. Each of the struts may be connectable to a respective one of the side frame members in a plurality of positions. Each of the struts is preferably pivotally connected to a respective one of the side frame members. The side frame members of the back frame may be pivotally connected to the main frame members.

In embodiments in which the convertible frame comprises a foot frame connected or connectable to a first end of each of the main frame members and a back frame connected or connectable to a second end of each of the main frame members, the flexible support preferably comprises a central portion that extends between the main frame members, a head portion configured to extend between the side frame members of the back frame and a foot portion configured to extend between the side frame members of the foot frame.

In preferred embodiments the head portion includes clips for securing the head portion to the side frame members of the back frame and the foot portion includes clips for securing the foot portion to the side frame members of the foot frame. Each of the clips preferably comprises an elongate resilient tubular member for engagement with the side frame member.

According to a second aspect of the present invention there is provided a rucksack comprising:

- a convertible frame according to the first aspect of the invention; and
- a bag attached to the convertible frame, the bag defining an internal volume for holding contents of the rucksack.

The bag preferably comprises a sleeve for receiving a part of one of the leg members of the convertible frame such that the bag is suspended from the convertible frame by the sleeve.

In preferred embodiments the rucksack comprises shoulder straps for carrying the rucksack on a person's back. The convertible frame is preferably at least partially disposed between a rear panel of the bag and the shoulder straps. The bag may comprise a rear cover, and at least a part of the convertible frame may be disposed between the rear panel of the bag and the rear cover, with the shoulder straps connected to the rear cover. Preferably the main frame members and the flexible support are disposed between the rear panel of the bag and the rear cover.

In preferred embodiments a first part of the convertible frame is disposed between a first portion of the rear cover and a base of the bag, a second part of the convertible frame is disposed between a second portion of the rear cover and the rear panel of the bag, and a third part of the convertible frame is disposed between a third portion of the rear cover and a top of the bag.

BRIEF DESCRIPTION OF THE DRAWINGS

The invention will now be further described by way of example only and with reference to the accompanying drawings, in which.

DETAILED DESCRIPTION

Figure 1:
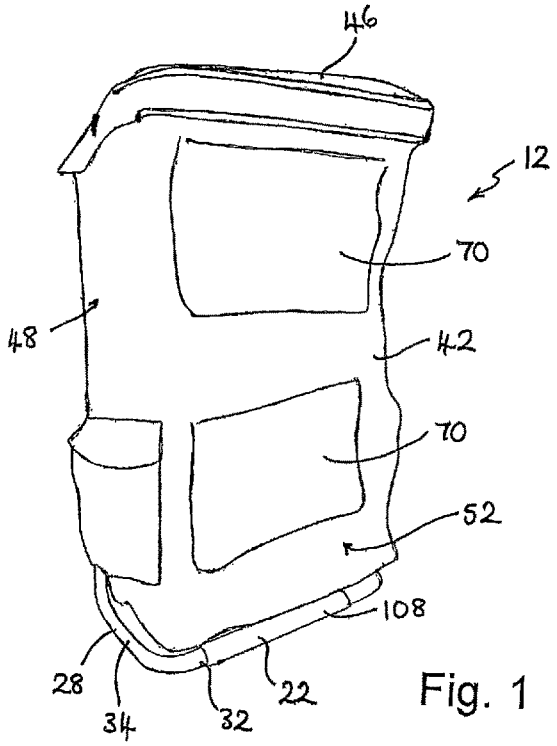
FIG. 1 is a perspective view from the front of a first embodiment of a rucksack including a frame according to a first preferred embodiment of the present invention, the frame being in a first configuration.

The accompanying FIGS. 1 to 8 show a convertible frame 10 according to a first embodiment of the present invention. The frame 10 is convertible between a first configuration in which the frame 10 forms part of a rucksack 12, and a second configuration in which the frame 10 forms part of a support 14 for a person, such as a chair or bed. Advantageously, the convertible frame 10 has a first width in the first configuration so that the rucksack 12 is easy and practical to carry and a second width in the second configuration so that the support 14 has sufficient width to form a comfortable chair or bed.

The convertible frame 10 includes two main frame members 16. The main frame members 16 are elongate; each extending between first and second ends 18, 20. In this embodiment the main frame members 16 extend parallel to each other in a side by side arrangement with a distance or spacing between them. Preferably the first ends 18 of the main frame members 16 are aligned with each other and the second ends 20 of the main frame members 16 are aligned with each other. The main frame members 16 are connected together by a pair of extendable connectors 22. The extendable connectors 22 are moveable between a collapsed or retracted configuration and an extended configuration, and movement of the extendable connectors 22 varies a distance between the main frame members 16. In particular, with the extendable connectors 22 in the retracted configuration there is a first distance between the main frame members 16 and with the extendable connectors 22 in the extended configuration there is a second distance between the main frame members 16; the second distance being larger than the first distance.

Each extendable connector 22 preferably comprises a pair of tubular members 24, 26 slidingly connected to each other; relative sliding of the tubular members 24, 26 increasing or decreasing a length of the extendable connector 22. The extendable connectors 22 may be telescopic.

The convertible frame 10 further comprises two leg members 28, 30. A first leg member 28 extends from and connects the first ends 18 of the main frame members 16 and a second leg member 30 extends from and connects the second ends 30 of the main frame members 16. In this embodiment each of the leg members 28, 30 is substantially U-shaped and includes a base portion 32 and two side portions 34. Each of the side portions 34 is joined to a respective one of the main frame members 16 at a first end 33 of the side portion 34 and the base portion 32 extends between second ends 35 of the side portions 34. In this embodiment each of the leg members 28, 30 comprises one of the extendable connectors 22. In particular the base portion 32 of each leg member 28, 30 is in the form of an extendable connector 22. A first section of each leg member 28, 30 includes one of the side portions 34 and a first part of the base portion 32, and a second section of each leg member 28, 30 includes the other one of the side portions 34 and a second part of the base portion 32. The first and second parts of the base portion 32 are in sliding engagement with each other so that an overall length of the base portion 32 can be varied, thereby varying a distance between the main frame members 16.

In this embodiment a first angle between the main frame members 16 and the side portions 34 of the first leg member 28 is different to a second angle between the main frame members 16 and the side portions 34 of the second leg member 30. The second angle is preferably greater than the first angle. The first angle is preferably between 90° and 120° and the second angle is preferably between 100° and 140°. Preferably a distance between the base portions 32 of the first and second leg members 28, 30 is greater than a length of the main frame members 16 between the first and second ends 18, 20. The angle between the leg members 28, 30 and the main frame members 16 is preferably fixed.

In a preferred embodiment the main frame members 16 and leg members 28, 30 are tubular members, so that the convertible frame 10 is strong and lightweight. In these embodiments the first part of the base portion 32 may be partially received within a bore of the second part of the base portion 32 such that the two parts are telescopically connected. By sliding the first and second parts of the base portion 32 with respect to each other, a length of the base portion 32 of the leg member 28, 30 can be changed, thereby altering a distance between the main frame members 16.

In particularly preferred embodiments the convertible frame 10 comprises a first tubular section 36 and a second tubular section 38. Each tubular section 36, 38 comprises one of the main frame members 16, a leg member side portion 34 extending from each end 18, 20 of the main frame member 16 and a part of a base portion 32 extending from each side portion 34. The first and second tubular sections 36, 38 are connected to form the complete frame 10 by sliding engagement of the parts of the base portions 32 as described above.

The convertible frame 10 may comprise a second pair of extendable connectors **22*b*. These extendable connectors 22*b* may extend between the main frame members 16 at a distance from the leg members 28, 30. In some embodiments, such as that shown in FIG. 9, a second extendable connector 22*b* may extend between the side portions 34 of each of the leg members 28, 30 substantially parallel to but spaced from the base portion 32 of the leg member 28, 30**.

In other embodiments the extendable connectors may be separate and distinct from the leg members. A separate leg member may extend from each of the first ends and each of the second ends of the main frame members. The extendable connectors may extend between the main frame members at a distance from the leg members.

A flexible support 40 is attached to and extends between the main frame members 16. The flexible support 40 may comprise a layer of fabric or a polymeric or elastomeric sheet, for example. In some embodiments the flexible support 40 may comprise a plurality of flexible strips extending between the main frame members 16.

It will be appreciated that the flexible support 40 is configured to accommodate a change in distance between the main frame members 16. The flexible support 40 may be elastically stretchable so that when the distance between the main frame members 16 is increased the flexible support 40 stretches and when the distance between the main frame members 16 is decreased the flexible support 40 returns to its original width. Alternatively, the flexible support 40 may not be stretchable. The flexible support 40 may have dimensions such that the flexible support 40 is pulled taut as the distance between the main frame members 16 is increased.

Figure 3:
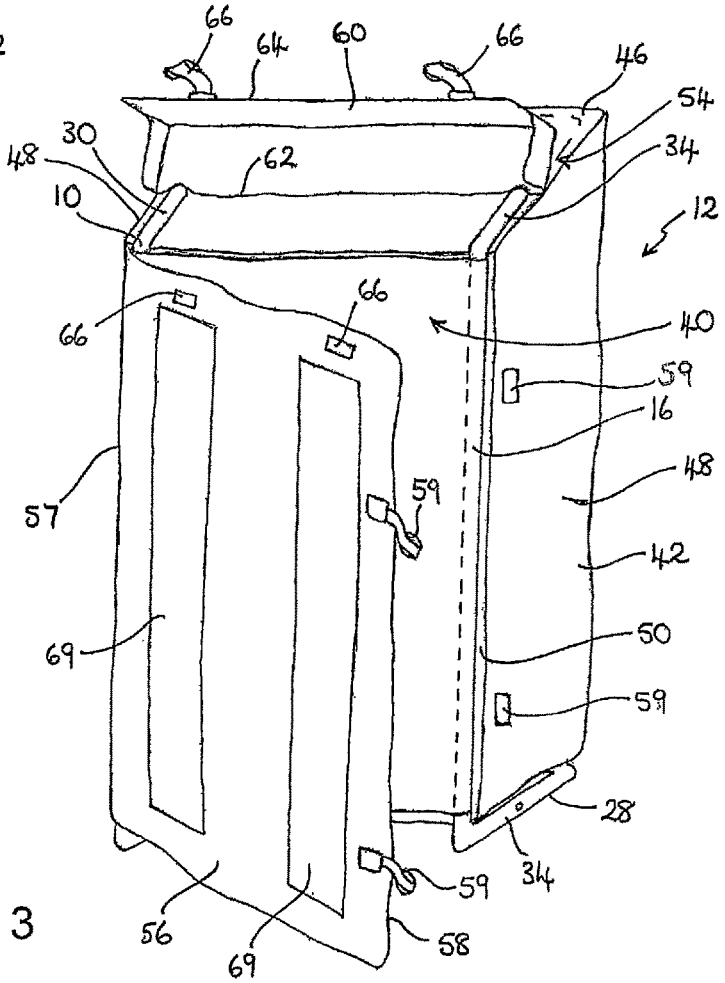
FIG. 3 is a perspective view from the rear of the rucksack of FIG. 1 showing a rear flap and a top flap in an open configuration to allow access to the frame.

With the convertible frame 10 in the first configuration and providing a frame for a rucksack 12, as shown most clearly in FIGS. 1 and 3, the distance between the main frame members 16 defines a width of the rucksack 12. This distance is preferably between 400 mm and 500 mm, and is most preferably about 450 mm. This makes the rucksack 12 easy to carry and not too bulky.

To form the rucksack 12 a bag 42 is connected to the convertible frame 10. The bag 42 comprises a base 44, a top 46, side wall portions or panels 48, a rear wall portion or panel 50 and a front wall portion or panel 52. The base 44, top 46, side wall portions 48, rear wall portion 50 and front wall portion 52 together define an interior volume of the bag 42.

In this embodiment the top 46 of the bag 42 comprises a pocket or sleeve 54 for receiving a part of the second leg member 30. The main frame members 16 extend along and down an exterior of the rear wall portion 50 of the bag 42 and the first leg member 28 extends under the base 44 of the bag 42. In this way, the interior volume of the bag 42 is substantially disposed within a space defined by the convertible frame 10, as shown most clearly in FIG. 2.

A rear flap or rear cover 56 is connected to the rear wall portion 50 of the bag 42. The rear flap 56 is preferably connected to the rear wall portion 50 along a first edge 57 between the rear wall portion 50 and a first one of the side wall portions 48. The rear flap 56 is extendable over the main frame members 16 and the flexible support 40 so that the main frame members 16 and flexible support 40 are disposed between the rear flap 56 and the rear wall portion 50 of the bag 42, as shown most clearly in FIG. 3. A free edge 58 of the rear flap 56, opposite the first edge 57, is securable to a second one of the side wall portions 48 by means of suitable clips or straps or similar fastening means 59, to retain the rear flap 56 closed over the main frame members 16.

Because the main frame members 16 and flexible support 40 are disposed between the rear wall portion 50 and rear flap 56 of the bag 42, the flexible support 40 advantageously provides additional padding at the rear of the rucksack 12 making the rucksack 12 more comfortable to carry.

In other embodiments the bag 42 may not include a rear flap 56 that extends over both main frame members 16. The bag 42 may include a separate cover that extends over each main frame member 16, or the bag 42 may include straps or clips which attach the rear wall portion 50 of the bag 42 to the main frame members 16.

It may also be desirable for the bag 42 to include straps or clips to connect the base 44 of the bag 42 to the first leg member 28. In embodiments in which the bag 42 is suspended from the second leg member 30, however, it is not necessary to directly connect the bag base 44 to the first leg member 28.

Figure 2:
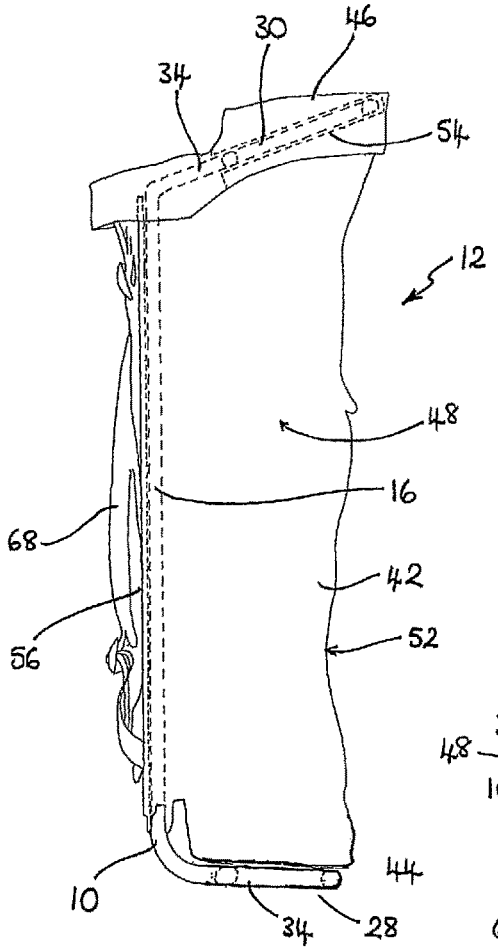
FIG. 2 is a side view of the rucksack of FIG. 1 showing the position of the frame relative to straps and an interior volume of the rucksack.

In the embodiment of FIGS. 1 to 3 the bag 42 further comprises a top flap or top cover 60. The top flap 60 is arranged to cover the remainder of the second leg member 30 not received in the sleeve 54 and to further connect the bag 42 to the convertible frame 10. As shown in FIG. 3, the top flap 60 is connected along a first edge 62 to the sleeve 54 and a second edge 64 of the top flap 60 is securable to the rear flap 56 by means of suitable clips or straps or similar fastening means 66. This arrangement makes it easier to insert the second leg member 30 into the sleeve 54 to attach the bag 42 to the convertible frame 10. In other embodiments the bag may not include a top flap and the second leg member may be substantially fully received in the sleeve.

It will be appreciated that the rucksack comprises a pair of shoulder straps 68 to enable the bag 42 to be carried in a conventional way as a rucksack. In the embodiment shown in FIGS. 1 to 3, the shoulder straps 68 are connected to and extend from regions 69 of the rear flap 56. In other embodiments the shoulder straps 68 may be connected to other suitable regions of the bag 42.

The rucksack 12 may include other straps for example a waist strap or hip belt and/or a chest or sternum strap that are included in traditional rucksacks. Some or all of the straps of the rucksack 12 may be adjustable in length. The rucksack 12 may also include a further back panel that is arranged to space the rear wall portion 50 and the rear flap 56 from a person's back when they are wearing the rucksack. This back panel may comprise a mesh and typically provides a space for ventilation between the bag and the person's back.

The advantage of connecting the bag 42 to the convertible frame 10 as described above is that the bag 42 may be attached to and removed from the frame 10 without having to remove the contents of the rucksack from the bag 42. In this embodiment, the bag 42 further comprises two access flaps 70 in the front wall portion 52 of the bag 42 to permit access to the interior volume of the bag 42. These flaps 70 allow access to the interior volume both when the bag 42 is connected to the convertible frame 10 and when the bag 42 has been separated from the convertible frame 10. It will be appreciated that in other embodiments the bag 42 may include fewer than or more than two access flaps.

Figure 4:
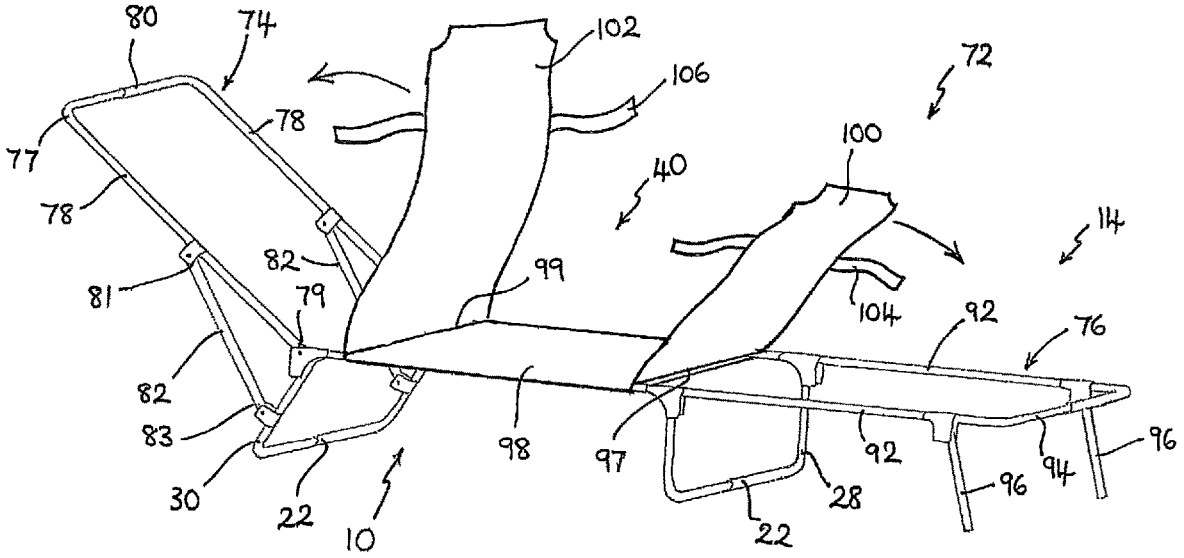
FIG. 4 shows the frame of FIG. 1 in a second configuration and forming part of a sun lounger or bed, with a flexible support in a partially unfolded configuration.
Figure 5:
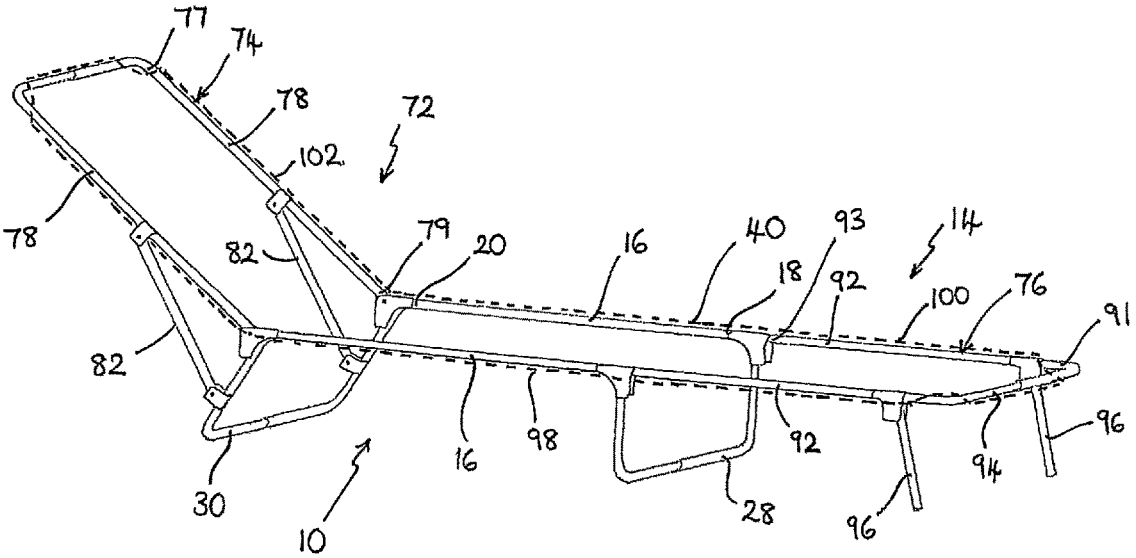
FIG. 5 shows the frame of FIG. 4, with dashed lines indicating the position of the flexible support in a fully unfolded configuration and attached to a back frame and a foot frame of the sun lounger.
Figure 6:
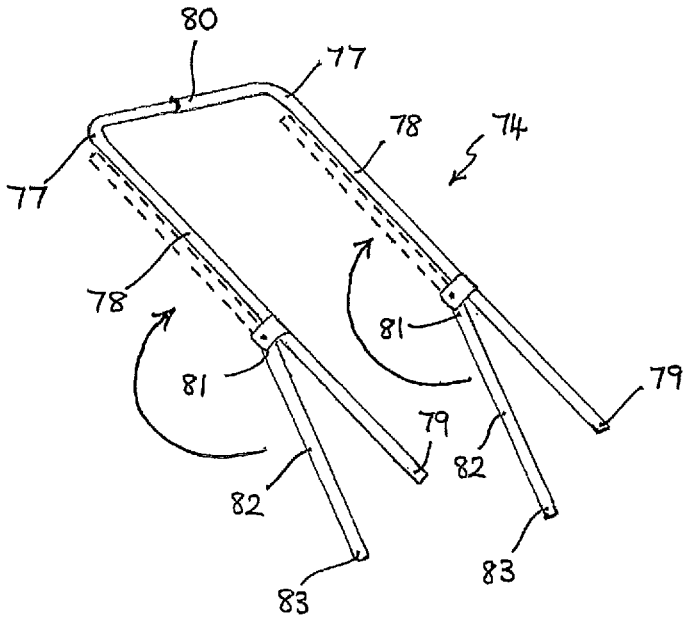
FIG. 6 shows the back frame of FIG. 5.
Figure 7:
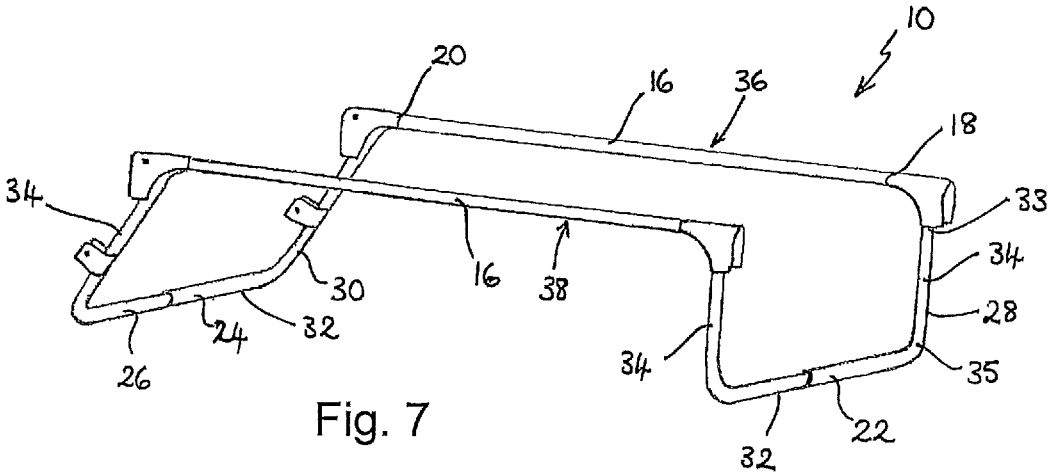
FIG. 7 shows the frame for the rucksack of FIG. 1 in its second configuration.

Once the convertible frame 10 has been separated from the bag 42 it may be moved into the second configuration to provide a support 14 for a person. In preferred embodiments, the convertible frame 10, in the second configuration, forms part of a chair or bed. A preferred embodiment of a bed 72 including the convertible frame 10 is shown in FIGS. 4 and 5. The bed 72 may be used as a sun lounger. With the convertible frame 10 in the second configuration the distance between the main frame members 16 defines a width of the bed or chair. This distance is preferably between 600 mm and 700 mm, and is most preferably about 620 mm.

In this embodiment the bed 72 further includes a back frame 74 and a foot frame 76. The back frame 74 shown most clearly in FIG. 6 comprises two side frame members 78 joined at their first ends 77 by a head frame member 80. The back frame 74 further comprises two struts 82, each strut 82 being connected to one of the side frame members 78. In particular a first end 81 of each strut 82 is connected to a respective side frame member 78 along the length of the side frame member 78 between first and second ends 77, 79 of the side frame member 78.

The second end 79 of each of the side frame members 78 is connectable to the second end 20 of a respective main frame member 16. The second end 83 of each of the struts 82 is connectable to the second leg member 30. With the back frame 74 connected to the convertible frame 10, an angle between the side frame members 78 and the main frame members 16 is determined by a length of the struts 82, the position of the first ends 81 of the struts 82 between the first and second ends 77, 79 of the side frame members 78, and a distance between the second ends 83 of the struts 82 and the second ends 20 of the main frame members 16. The first end 81 of each strut 82 may be pivotally connected to a respective one of the side frame members 78. The second end 83 of each strut 82 may be pivotally connected to the second leg member 30.

In some embodiments an angle between the back frame 74 and the convertible frame 10 is adjustable. The angle may be adjusted by altering a length of the struts 82, moving the position of the first ends 81 of the struts 82 relative to the first and second ends 77, 79 of the side frame members 78, and/or changing the distance between the second ends 83 of the struts 82 and the second ends 20 of the main frame members 16.

Figure 9:
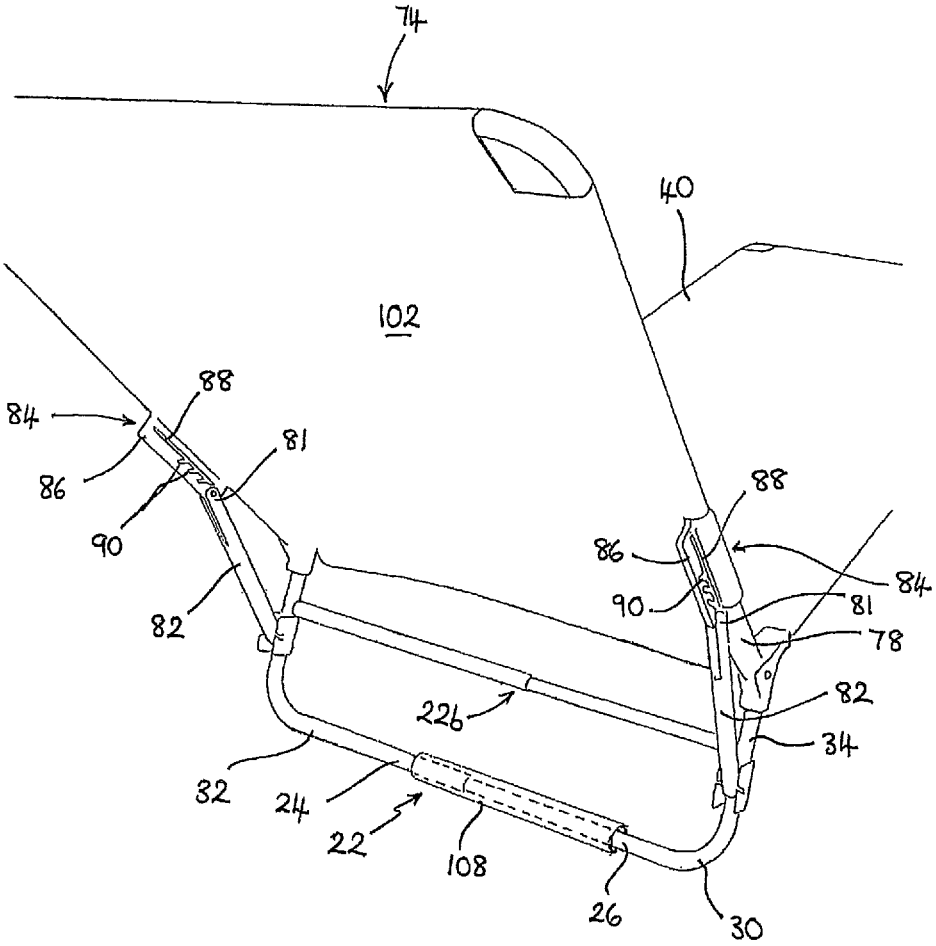
FIG. 9 shows part of a further embodiment of a frame in its second configuration.

In one embodiment, shown in FIG. 9, an adjuster 84 is connected to each of the side frame members 78 of the back frame 74. Each adjuster 84 comprises a plate 86 including a slot 88. The slot 88 extends parallel to the side frame member 78 and the slot 88 has a series of notches or branches 90 along its length. The first end 81 of each of the struts 82 includes a pin or rod that is engaged with the slot 88. By seating the pin in a different one of the notches 90, the position of the first end 81 of the strut 82 along the slot 88, and therefore along the side frame member 78, is altered. This changes the angle between the back frame 74 and the main frame members 16.

It will be appreciated that in other embodiments the back frame and/or the convertible frame may comprise other means to allow the back frame to be secured in a plurality of different positions with respect to the convertible frame such that an angle between the side frame members of the back frame and the main frame members of the convertible frame may be varied.

Figure 8:
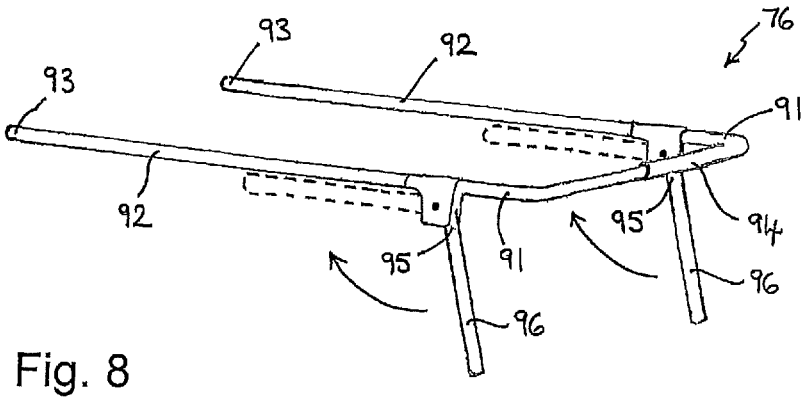
FIG. 8 shows the foot frame of FIG. 5.

The foot frame 76 shown most clearly in FIG. 8 comprises two side frame members 92 joined at their first ends 91 by a cross member 94. The foot frame 76 further comprises two legs 96, each leg 96 being connected to one of the side frame members 92. In particular a first end 95 of each leg 96 is connected to a respective side frame member 92 proximate the cross member 94. In a deployed configuration the legs 96 extend substantially perpendicularly from the side frame members 92. An angle between the legs 96 and the side frame members 92 may be between 90° and 130°. A second end 93 of each of the side frame members 92 is connectable to the first end 18 of a respective main frame member 16.

To allow a person to lie on the bed 72, in this embodiment the flexible support 40 comprises a central portion 98, a foot portion 100 and a head portion 102. The central portion 98 is attached to the main frame members 16 along opposite side edges. The foot portion 100 extends from a first end edge 97 of the central portion 98 and the head portion 102 extends from an opposite second end edge 99 of the central portion 98. With the convertible frame 10 in the second configuration and the foot frame 76 and back frame 74 connected to the convertible frame 10, the foot portion 100 of the flexible support 40 may be attached to one or all of the side frame members 92 and cross member 94 so as to extend over the foot frame 76, and the head portion 102 of the flexible support 40 may be attached to one or all of the side frame members 78 and head frame member 80 so as to extend over the back frame 74, as indicated in FIG. 5. The foot portion 100 of the flexible support 40 may be attached to the foot frame 76 by straps 104 or clips or the like. The head portion 102 of the flexible support 40 may be attached to the back frame 74 by straps 106 or clips or the like. In preferred embodiments the foot portion 100 of the flexible support 40 includes a sleeve within which at least a part of the foot frame 76 is received. The head portion 102 of the flexible support 40 may also include a sleeve within which at least a part of the back frame 74 is received.

In preferred embodiments the central portion 98, foot portion 100 and head portion 102 of the flexible support 40 are integrally formed. As such, in these embodiments, when the frame 10 is converted into the first configuration, the complete flexible support 40, including the central portion 98, foot portion 100 and head portion 102, is disposed between the rear wall portion 50 and the rear flap 56 of the bag 42.

To enable the complete bed 72 to be carried in the rucksack 12, the foot frame 76 and back frame 74 are preferably convertible into a folded configuration. The struts 82 of the back frame 74 may be pivotally connected to the side frame members 78 so that the struts 82 can be folded into a position in which they extend parallel to the side frame members 78, as shown by the dashed lines in FIG. 6. Similarly, the legs 96 of the foot frame 76 may be pivotally connected to the side frame members 92 so that the legs 96 can be folded into a position in which they extend parallel to the side frame members 92, as shown by the dashed lines in FIG. 8.

As described above, the distance between the main frame members 16 in the first configuration is less than the distance between the main frame members 16 in the second configuration. Accordingly, to enable the foot frame 76 and the back frame 74 to be accommodated in the rucksack 12, it may also be necessary to decrease a distance between the side frame members 92 of the foot frame 76 and the side frame members 78 of the back frame 74. In the embodiment shown in FIGS. 6 and 8, each of the head frame member 80 and the cross member 94 are formed in two parts which are slidably connected to allow a distance between the respective side frame members 78, 92 to be altered. The head frame member 80 and the cross member 94 may be telescopic, or may include an extendable connector 22.

In other embodiments each of the head frame member 80 and cross member 94 includes two separable parts. This allows the side frame members 92 of the foot frame 76 to be separated and the side frame members 78 of the back frame 74 to be separated. All four frame components formed due to this separation can then be stowed separately in the rucksack 12.

In other embodiments the foot frame 76 and the back frame 74 may remain attached to the convertible frame 10 when the convertible frame 10 is in the first configuration. The second ends 79 of the side frame members 78 of the back frame 74 may be pivotally connected to the second ends 30 of the main frame members 16. The second ends 93 of the side frame members 92 of the foot frame 76 may be pivotally connected to the first ends 28 of the main frame members 16.

In other embodiments the distance between the side frame members 92 of the foot frame 76 and the distance between the side frame members 78 of the back frame 74 are both less than the distance between the main frame members 16. Additionally, both the head frame member 80 and the cross member 94 include an extendable connector 22. In these embodiments, when the convertible frame 10 is moved into the first configuration, the cross member 94 and the head frame member 80 are also collapsed. The foot frame 76 and the back frame 74 may then be pivoted with respect to the convertible frame 10 so that the main frame members 16 and the side frame members 78, 92 lie in the same plane. The complete frame of the bed 72 may then be accommodated within a rear part of the bag 42 of the rucksack 12, for example between the rear wall portion 50 and the rear flap 56.

In some embodiments the side frame members of the foot frame and/or the back frame may be receivable within a part of the main frame members when the convertible frame is in the first configuration. The main frame members and the side frame members may be telescopic or otherwise slidably connected.

It will be appreciated that, in use, the bed 72 is supported on the leg members 28, 30 of the convertible frame 10 and on the legs 96 of the foot frame 76. In embodiments in which the base portions 32 of the leg members 28, 30 comprise extendable connectors 22 that include telescopic sections it may be advantageous if a cover or sleeve 108 is disposed over and around at least a part of the telescopic sections, as shown in the embodiment of FIG. 9. In particular, the sleeve 108 is preferably configured to prevent ingress of dirt, sand or other particulate material into a join or connection between the telescopic sections which would otherwise prevent or hinder smooth movement of the telescopic sections relative to each other. In other embodiments other means may be provided that prevent ingress of dirt, sand or other particulate material into the join or connection between the telescopic sections.

The convertible frame may include a latching or locking mechanism to allow the frame to be latched in the first configuration and/or the second configuration. In preferred embodiments the latching mechanism comprises means for latching the extendable connector in the retracted configuration and means for latching the extendable connector in the extended configuration. In embodiments in which the extendable connector comprises a pair of tubular members slidingly connected to each other the latching mechanism may comprise a biased member or retractable pin attached to one of the tubular members and a hole or a series of holes in the other one of the tubular members. The retractable pin is biased to locate in the hole or one of the holes to retain the tubular members in a fixed position with respect to each other. In some embodiments, the pin may locate in a first one of the holes with the extendable connector in the retracted configuration and in a second one of the holes with the extendable connector in the extended configuration. To allow relative movement of the tubular members between the retracted and extended configurations, the pin can be pressed or retracted to release the pin from the hole such that the tubular members can be slid relative to each other until the pin locates in the other one of the holes.

In some embodiments the support for a person may be in the form of a camp bed. In these embodiments the bed may comprise two foot frames, a first foot frame being connected or connectable to the first end of the main frame members and a second foot frame being connected or connectable to the second end of the main frame members. In these embodiments, therefore, the bed does not include a back frame and the bed is in the form of a flat support for a person.

In other embodiments the support for a person may be in the form of a chair or stool. The support may include a back frame that is connectable to the first ends of the main frame members and may not include any part that is connectable to the second ends of the main frame members. Alternatively, the support may not include a foot frame or a back frame, but may only comprise the convertible frame.

In further embodiments the flexible support may form at least a part of the bag of the rucksack. In particular, the flexible support may form all or part of the base, top, side wall portions, rear wall portion and front wall portion of the bag. In these embodiments the rucksack may comprise one or more inner bags or sacks to hold the contents of the rucksack. When it is desired to convert the convertible frame from the first configuration to the second configuration, the contents of the rucksack are removed from the bag, and the flexible support is opened or unfolded from a configuration in which the flexible support forms the bag to a different configuration in which the flexible support is suspended from the frame to form a chair or bed for supporting a person.

It may be desirable if the bag of the rucksack comprises two or more interchangeable pods or sections. Each of the pods or sections may have a different primary function, for example one of the sections may be padded for carrying a camera and one of the sections may be insulated for transporting food and drink. The interchangeable pods or sections may be attached individually to each other to form the complete bag so that, for example, a rear panel of each of the pods forms a part of the rear wall panel of the bag. Alternatively, each of the pods or sections may be insertable into a single outer cover, and the outer cover includes at least the base, top, side wall portions, and rear wall portion of the bag. By providing a set of interchangeable pods, the rucksack may be tailored for a particular purpose or type of outing, for example a nature trek or a picnic.

The accompanying FIGS. 10 to 19 show a convertible frame 210 and rucksack 212 according to a second embodiment of the present invention. The rucksack and frame are substantially similar to the rucksack and frame of the first embodiment described above, and like features have been indicated by reference numerals incremented by 200. The frame 210 is convertible between a first configuration in which the frame 210 forms part of or may be housed within a rucksack 212, and a second configuration in which the frame 210 forms part of a support 214 for a person, such as a chair or bed. Advantageously, the convertible frame 210 has a first width of about 460 mm, in the first configuration, so that the rucksack 212 is easy and practical to carry, and a second width of about 620 mm, in the second configuration, so that the support 214 has sufficient width to form a comfortable chair or bed.

Figure 16:
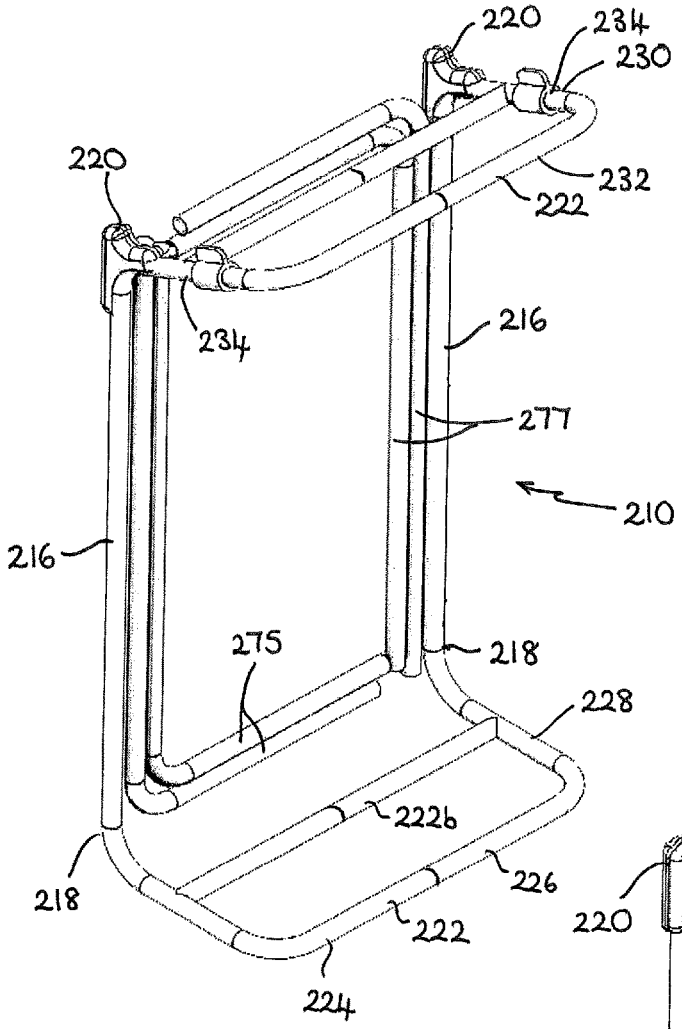
FIG. 16 shows the frame of FIG. 14 in the first configuration.
Figure 17:
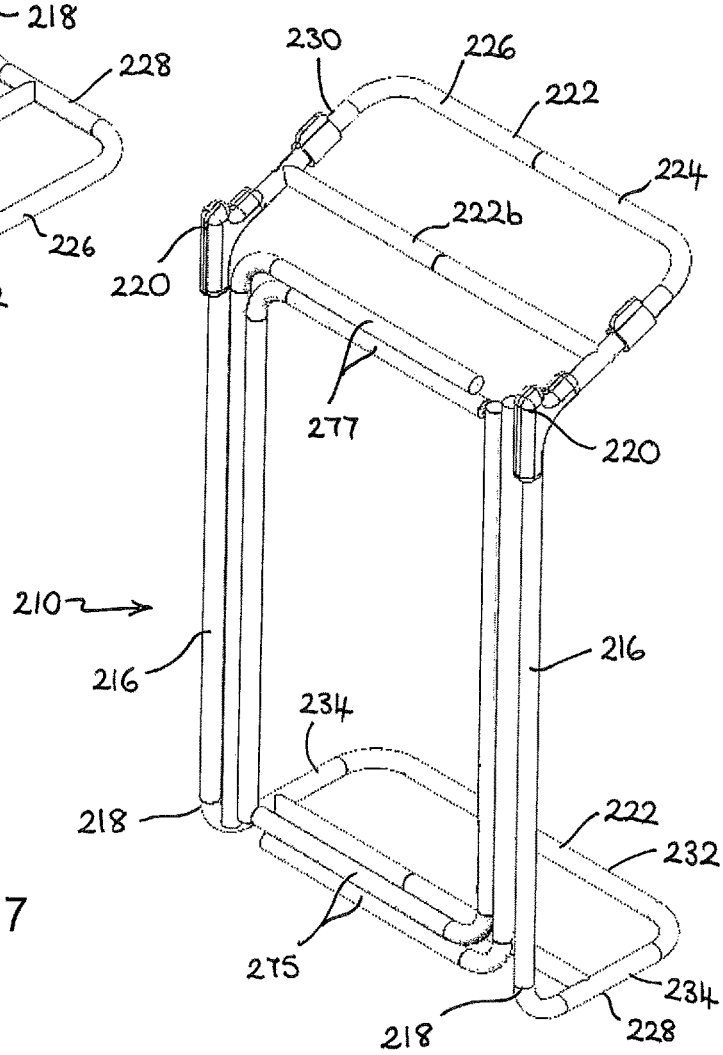
FIG. 17 shows the frame of FIG. 14 in the first configuration.

As shown most clearly in FIGS. 16 and 17, the convertible frame 210 includes two main frame members 216. The main frame members 216 are elongate; each extending between first and second ends 218, 220. In this embodiment the main frame members 216 extend parallel to each other in a side by side arrangement with a distance or spacing between them. Preferably the first ends 218 of the main frame members 216 are aligned with each other and the second ends 220 of the main frame members 216 are aligned with each other. The main frame members 216 are connected together by a pair of extendable connectors 222. The extendable connectors 222 are moveable between a collapsed or retracted configuration and an extended configuration, and movement of the extendable connectors 222 varies a distance between the main frame members 216. In particular, with the extendable connectors 222 in the retracted configuration there is a first distance between the main frame members 216 and with the extendable connectors 222 in the extended configuration there is a second distance between the main frame members 216; the second distance being larger than the first distance.

Each extendable connector 222 preferably comprises a pair of tubular members 224, 226 slidingly connected to each other; relative sliding of the tubular members 224, 226 increasing or decreasing a length of the extendable connector 222. The extendable connectors 222 may be telescopic.

The convertible frame 210 further comprises two leg members 228, 230. A first leg member 228 extends from and connects the first ends 218 of the main frame members 216 and a second leg member 230 extends from and connects the second ends 230 of the main frame members 216. In this embodiment each of the leg members 228, 230 is substantially U-shaped and includes a base portion 232 and two side portions 234, as described above in relation to the first embodiment. In this embodiment each of the leg members 228, 230 comprises one of the extendable connectors 222. In particular the base portion 232 of each leg member 228, 230 is in the form of an extendable connector 222. A first section of each leg member 228, 230 includes one of the side portions 234 and a first part of the base portion 232, and a second section of each leg member 228, 230 includes the other one of the side portions 234 and a second part of the base portion 232. The first and second parts of the base portion 232 are in sliding engagement with each other so that an overall length of the base portion 232 can be varied, thereby varying a distance between the main frame members 216.

In a preferred embodiment the main frame members 216 and leg members 228, 230 are tubular members, so that the convertible frame 210 is strong and lightweight. In these embodiments the first part of the base portion 232 may be partially received within a bore of the second part of the base portion 232 such that the two parts are telescopically connected. By sliding the first and second parts of the base portion 232 with respect to each other, a length of the base portion 232 of the leg member 228, 230 can be changed, thereby altering a distance between the main frame members 216.

In this embodiment the convertible frame 210 also includes a second pair of extendable connectors 222*b* as described above.

Figure 18:
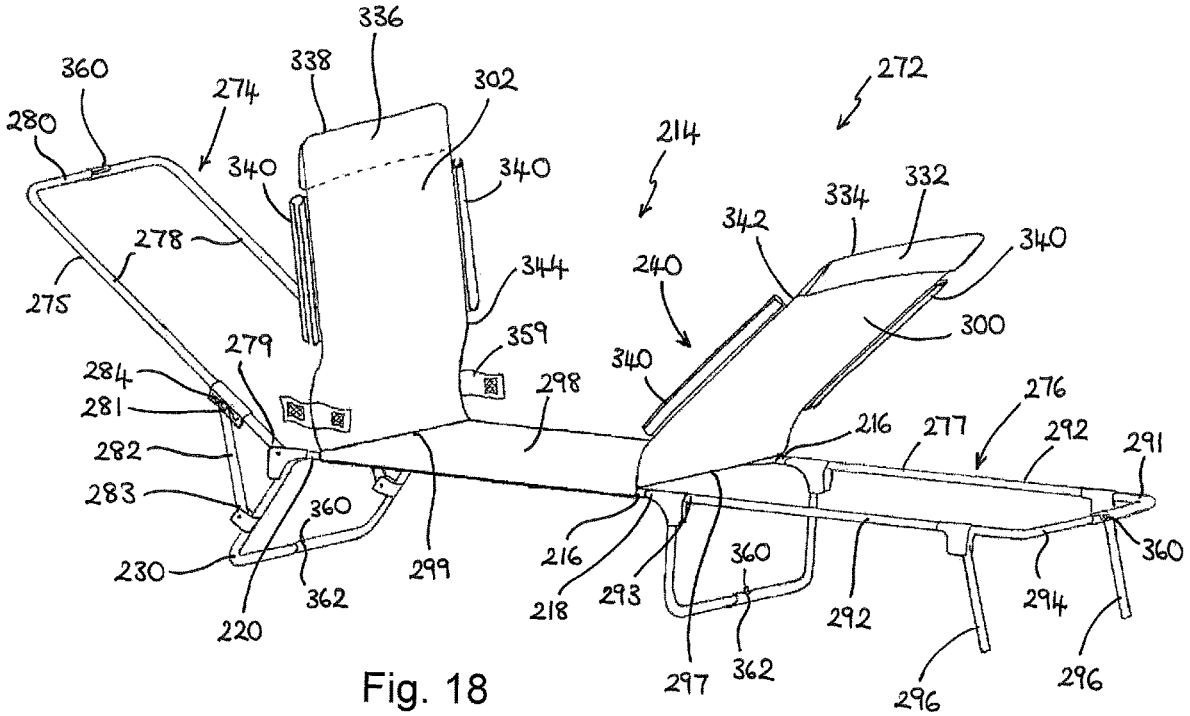
FIG. 18 shows the frame of FIG. 17 in a second configuration and forming part of a sun lounger or bed, with a flexible support in a partially unfolded configuration.
Figure 19A:
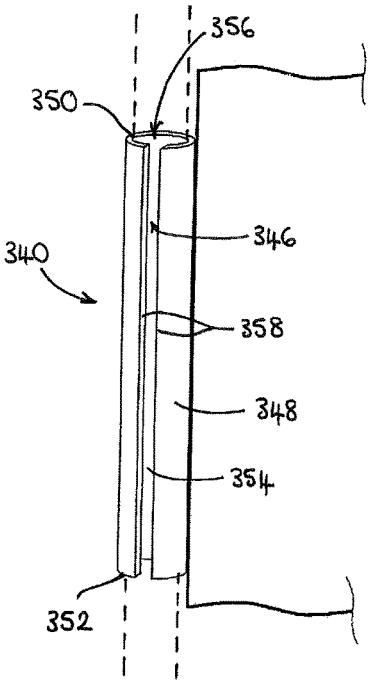
FIGS. 19*a* and 19*b* show a securement member for securing a part of the flexible support of FIG. 18 to the frame.
Figure 19B:
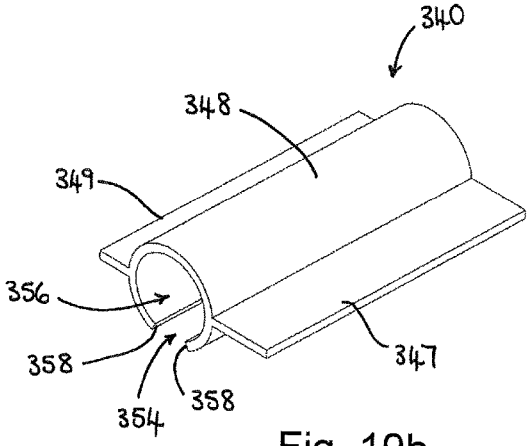
Figure 20:
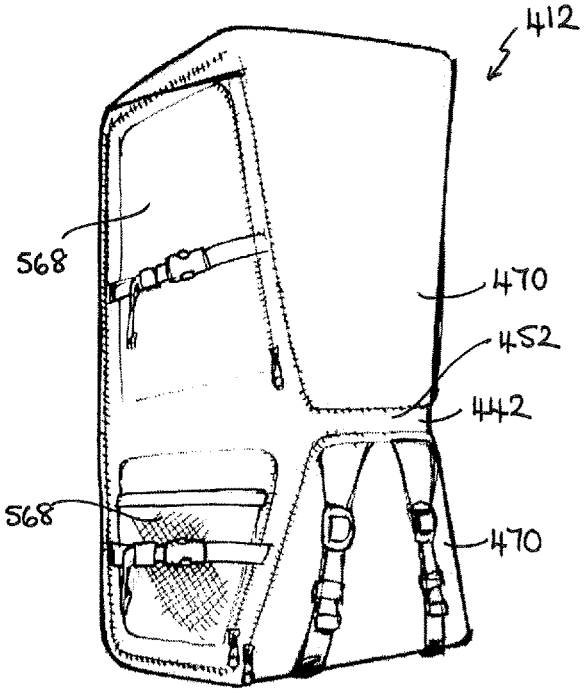
FIG. 20 is a perspective view of a rucksack according to a third preferred embodiment of the present invention.
Figure 21:
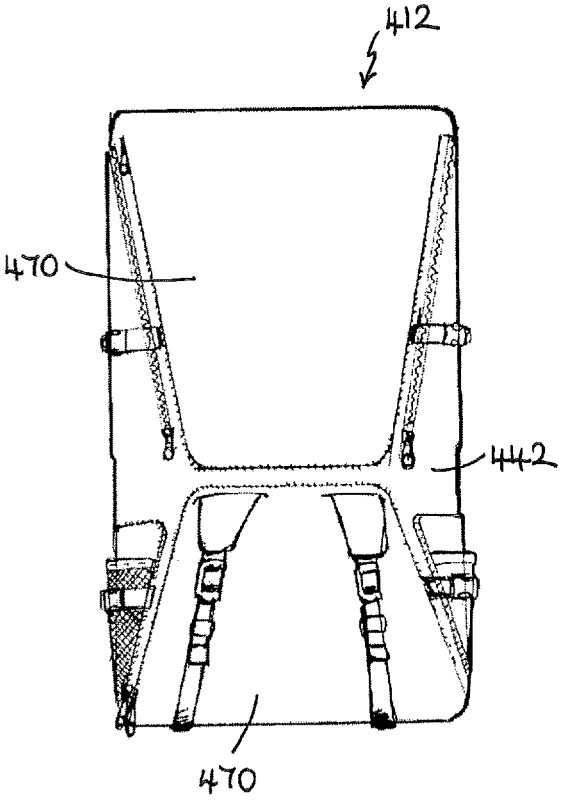
FIG. 21 is a front view of the rucksack of FIG. 20.
Figure 22:
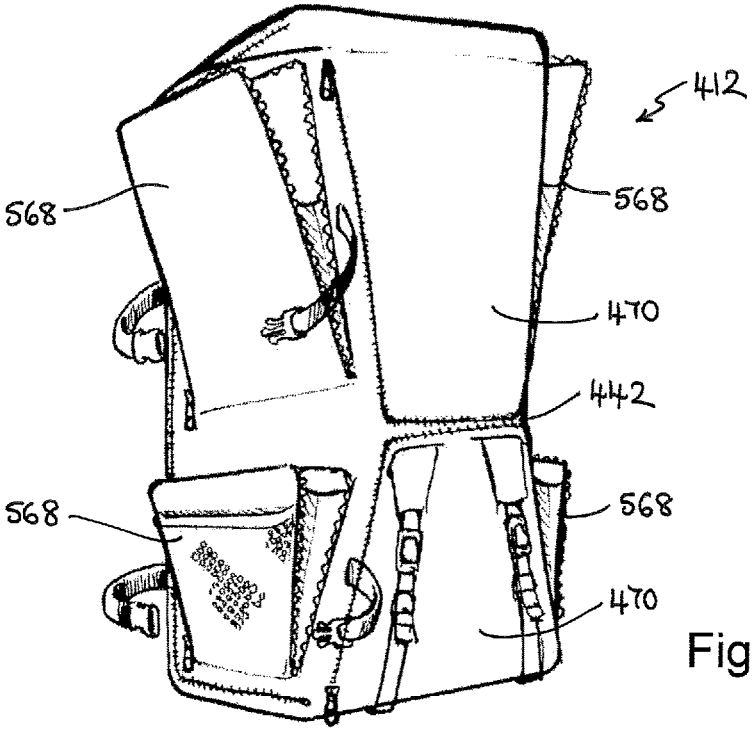
FIG. 22 is a view of the rucksack of FIG. 20 showing side pockets of the rucksack in an open configuration.

Referring now to FIGS. 18, 19*a* and 19*b*, a flexible support 240 is attached to and extends between the main frame members 216. The flexible support 240 preferably comprises a layer of fabric or a polymeric or elastomeric sheet. It will be appreciated that the flexible support 240 is configured to accommodate a change in distance between the main frame members 216. As such, the flexible support 240 may be elastically stretchable so that when the distance between the main frame members 216 is increased the flexible support 240 stretches and when the distance between the main frame members 216 is decreased the flexible support 240 returns to its original width. Alternatively, the flexible support 240 may not be stretchable. The flexible support 240 may have dimensions such that the flexible support 240 is pulled taut as the distance between the main frame members 216 is increased.

Figure 14:
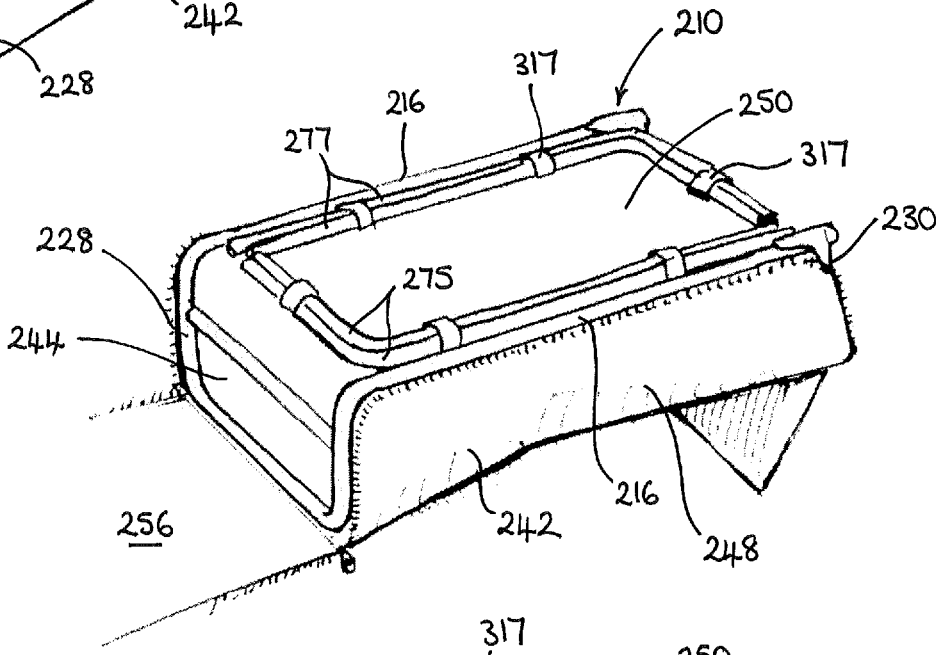
FIG. 14 shows the rucksack of FIG. 13 with the rear flap of the rucksack in an open configuration and showing the location of the frame in the rucksack, the frame being in a first configuration.

With the convertible frame 210 in the first configuration and housed within the rucksack 212, as shown most clearly in FIG. 14, the distance between the main frame members 216 defines a width of the rucksack 212.

To form the rucksack 212 a bag 242 is connected to the convertible frame 210. The bag 242 comprises a base 244, a top 246, side wall portions or panels 248, a rear wall portion or panel 250 and a front wall portion or panel 252. The base 244, top 246, side wall portions 248, rear wall portion 250 and front wall portion 252 together define an interior volume of the bag 242.

Figure 15:
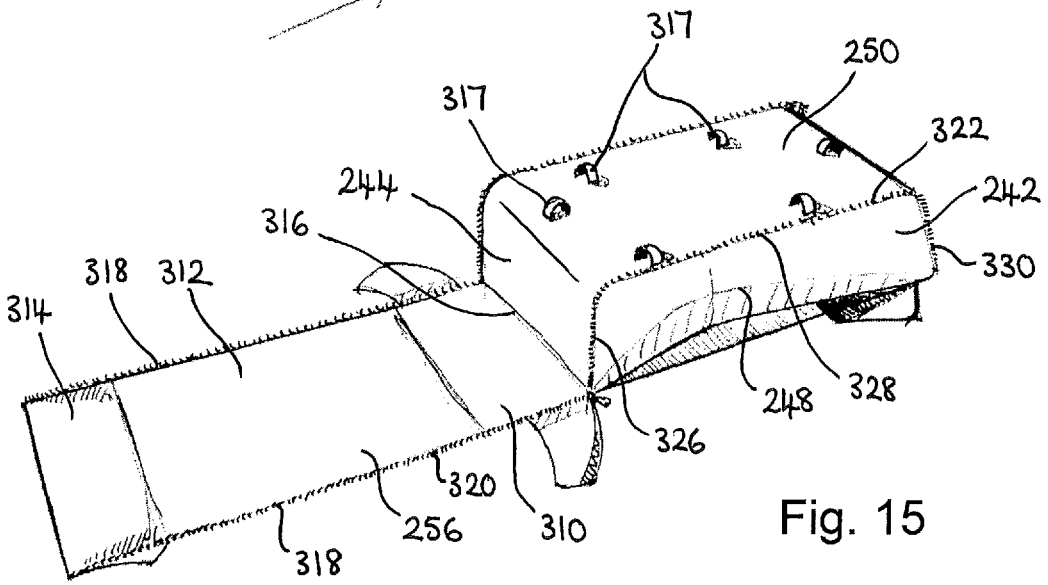
FIG. 15 shows the rucksack of FIG. 14 with the frame removed from the rucksack.

A rear flap or rear cover 256 is connected to the bag 242. In this embodiment, and as shown in FIG. 15, the rear flap 256 includes a lower panel or lower portion 310, a main panel or portion 312 and an upper panel or portion 314. The lower portion 310 of the rear flap 256 is connected to the base 244 of the bag 242 along an edge 316 between the base 244 and the front wall portion 252. In a closed configuration, the rear flap 256 extends over the base 244, the rear wall portion 250 and the top 246 of the bag 242. Furthermore, in this closed configuration the rear flap 256 is extendable over the frame 210 and the flexible support 240 so that the frame 210 and flexible support 240 are disposed between the rear flap 256 and the bag 242, as shown most clearly in FIG. 13.

In this embodiment, when the frame 210 is housed within the rucksack 212 in the first configuration, the first leg member 228 is disposed between the base 244 of the bag 242 and the lower portion 310 of the rear flap 256, the second leg member 230 is disposed between the top 246 of the bag 242 and the upper portion 314 of the rear flap 256, and the main frame members 216 are disposed between the rear wall portion 250 of the bag 242 and the main portion 312 of the rear flap 256. In this way, the interior volume of the bag 242 is substantially disposed within a space defined by the convertible frame 210, as shown most clearly in FIGS. 12 and 13.

The frame 210 may be secured to the bag 242 by straps or clips 317 as shown in FIGS. 14 and 15. In particular, in preferred embodiments, straps 317 are provided on the rear wall portion 250 of the bag 242. The straps 317 may be provided to secure all or part of the frame 210 to the bag 242. The straps 317 are preferably located on the rear wall portion 250 of the bag 242 (and optionally the base 244 and top 246 of the bag 242) such that a user correctly locates the frame 210 on the bag 242.

Side edges 318 of the rear flap 256 are preferably securable to the bag 242 to close the rear flap 256, such that the frame 210 is disposed between the rear flap 256 and the bag 242, and the frame 210 is substantially fully covered by the rear flap 256. In this embodiment the rear flap 256 includes a first part 320 of a zip 324 that extends along each of the side edges 318 of the rear flap 256. A second part 322 of each of the zips 324 is provided on the bag 242. In particular, in a preferred embodiment, the first part 320 of each zip 324 extends fully along each of the side edges 318 of the rear flap 256, such that the first part 320 of the zip 324 extends along the lower portion 310, main portion 312 and upper portion 314 of the rear flap 256. In these embodiments the second part 322 of each zip 324 extends along a side edge 326 of the base 244, a side edge 328 of the rear wall portion 250 and a side edge 330 of the top 246 of the bag 242.

With the rear flap 256 closed, a free end edge 321 of the rear flap 256 lies adjacent a front edge 323 of the top 246 of the bag 242.

In other preferred embodiments the zip also extends along the end edge 321 of the rear flap 256. In these embodiments, the first part 320 of each zip 324 extends fully along each of the side edges 318 of the rear flap 256 and across at least a part of the end edge 321 of the rear flap 256, such that the first part 320 of the zip 324 extends along the lower portion 310, main portion 312 and upper portion 314 of the rear flap 256. The second part 322 of each zip 324 extends along a side edge 326 of the base 244, a side edge 328 of the rear wall portion 250, a side edge 330 of the top 246 of the bag 242 and across the top 246 of the bag 242 proximate and substantially parallel to the front edge 323.

It will be appreciated that in other embodiments the rear flap 256 may be secured closed using any suitable securing means or fasteners. In particular, the rear flap 256 may be secured in its closed position by one or more of suitable clips, straps, toggles, hook and loop fastener, or similar reusable fasteners.

Figure 10:
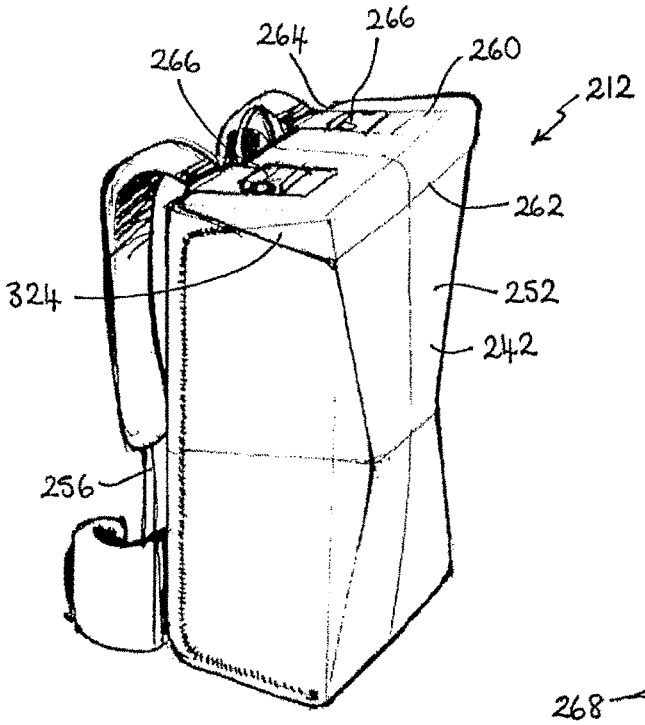
FIG. 10 is a perspective view of a second embodiment of a rucksack including a frame according to a second preferred embodiment of the present invention.
Figure 11:
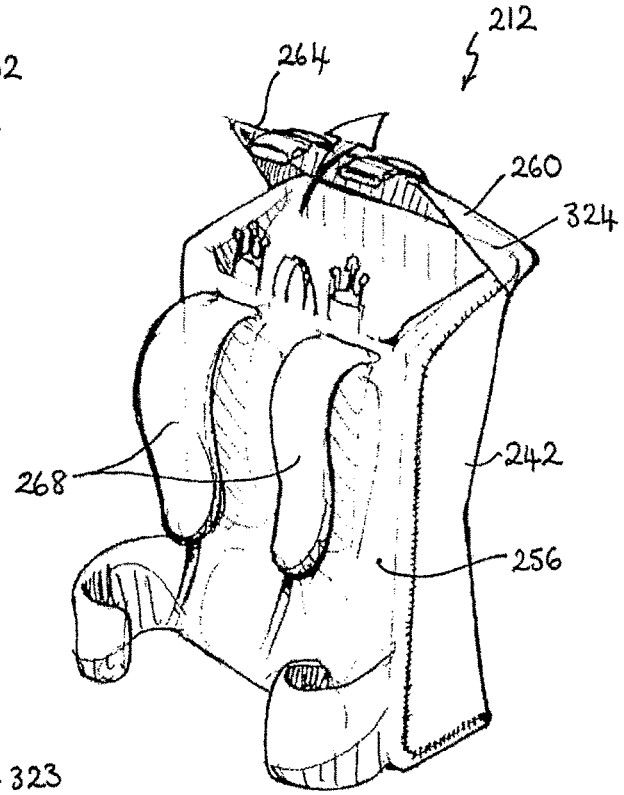
FIG. 11 shows the rucksack of FIG. 10 with a top flap of the rucksack opened to provide access to the frame.
Figure 12:
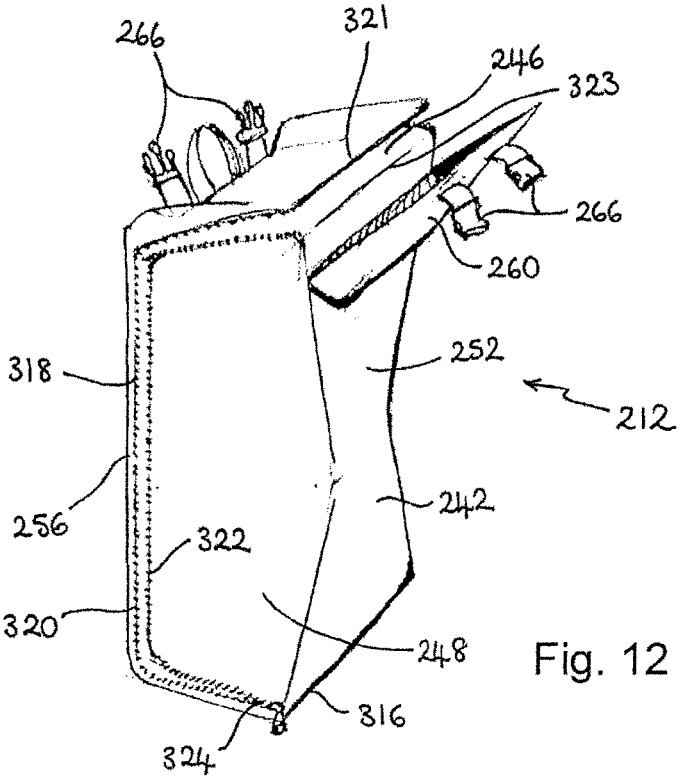
FIG. 12 shows the rucksack of FIG. 11 with a rear flap of the rucksack in a first partially open configuration.
Figure 13:
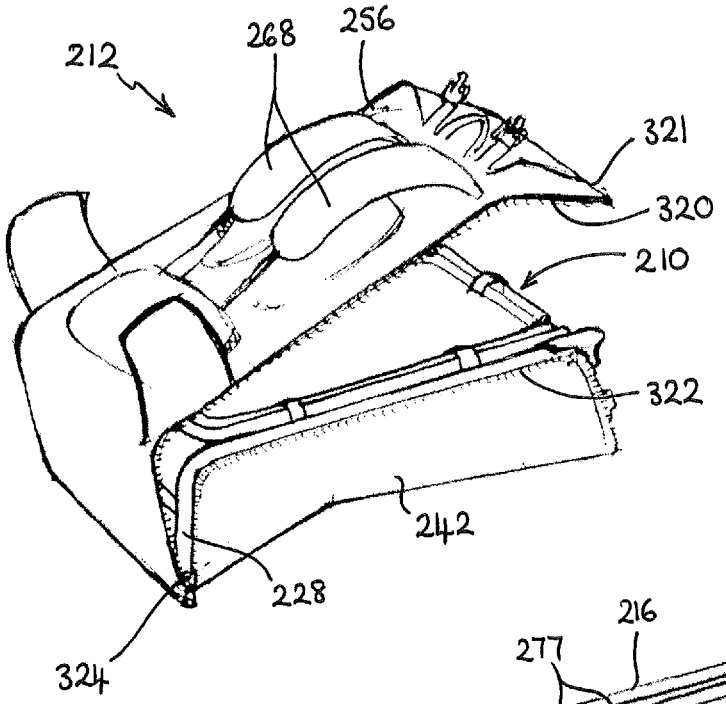
FIG. 13 shows the rucksack of FIG. 12 with the rear flap of the rucksack in a second partially open configuration.

As shown most clearly in FIGS. 10 to 12, in this embodiment the rucksack 212 further comprises a top flap or top cover 260. The top flap 260 is arranged to cover the end edge 321 of the rear flap 256. The top flap 260 is connected along a first edge 262 to an upper region of the front wall portion 252 of the bag 242. A second edge 264 of the top flap 260 is securable to the rear flap 256 by means of a suitable fastener 266. A first part of the fastener 266 is preferably provided on the top flap 260 and a second part of the fastener 266 is preferably provided on the rear flap 256. In this embodiment the fastener 266 is a buckle clip, and more particularly a side release buckle clip. In other embodiments the fastener 266 may, for example, be any suitable clip, buckle, strap, zip, toggle, or hook and loop fastener. The top flap 260 preferably includes side panels 324 that extend over at least a part of the side edge 318 of the upper portion 314 of the rear flap 256, when both the rear flap 256 and top flap 260 are closed. The provision of a top flap 260 that covers at least the end edge 321 of the rear flap 256 helps to prevent water (e.g. rain) and particulate matter (e.g. dirt, sand, stones) entering the space between the rear flap 256 and the bag 242. Furthermore, the top flap 260 provides tension between the front wall portion 252 of the bag 242 and the rear flap 256, such that the bag 242 is held securely to the frame 210.

It will be appreciated that the rucksack comprises a pair of shoulder straps 268 to enable the bag 242 to be carried in a conventional way as a rucksack. As shown most clearly in FIGS. 11 and 13, in this embodiment the shoulder straps 268 are connected to and extend from the rear flap 256.

The rucksack 212 may include other straps for example a waist strap or hip belt and/or a chest or sternum strap that are included in traditional rucksacks. Some or all of the straps of the rucksack 212 may be adjustable in length. The rucksack 212 may also include a further back panel that is arranged to space the rear flap 256 from a person's back when they are wearing the rucksack. This back panel may comprise a mesh and typically provides a space for ventilation between the bag and the person's back.

Once the convertible frame 210 has been separated from the bag 242 it may be moved into the second configuration to provide a support 214 for a person. In preferred embodiments, the convertible frame 210, in the second configuration, forms part of a chair or bed. A preferred embodiment of a bed 272 including the convertible frame 210 is shown in FIG. 18. The bed 272 may be used as a sun lounger. With the convertible frame 210 in the second configuration the distance between the main frame members 216 defines a width of the bed or chair. This distance is preferably between 600 mm and 700 mm, and is most preferably about 620 mm.

In this embodiment the bed 272 further includes a back frame 274 and a foot frame 276. The back frame 274 comprises two side frame members 278 joined at their first ends 277 by a head frame member 280. The back frame 274 further comprises two struts 282, each strut 282 being connected to one of the side frame members 278. In particular a first end 281 of each strut 282 is connected to a respective side frame member 278 along the length of the side frame member 278 between first and second ends 277, 279 of the side frame member 278.

The second end 279 of each of the side frame members 278 is connectable to the second end 220 of a respective main frame member 216. A second end 283 of each of the struts 282 is connectable to the second leg member 230. With the back frame 274 connected to the convertible frame 210, an angle between the side frame members 278 and the main frame members 216 is determined by a length of the struts 282, the position of the first ends 281 of the struts 282 between the first and second ends 277, 279 of the side frame members 278, and a distance between the second ends 283 of the struts 282 and the second ends 220 of the main frame members 216.

In this embodiment an angle between the back frame 274 and the convertible frame 210 is adjustable. An adjuster 284 is provided on each of the side frame members 278 of the back frame 274. Each adjuster 284 comprises a plate including a slot. The slot extends parallel to the side frame member 278 and the slot has a series of notches or branches along its length. The first end 281 of each of the struts 282 includes a pin or rod that is engaged with the slot. By seating the pin in a different one of the notches, the position of the first end 281 of the strut 282 along the slot, and therefore along the side frame member 278, is altered. This changes the angle between the back frame 274 and the main frame members 216.

The foot frame 276 comprises two side frame members 292 joined at their first ends 291 by a cross member 294. The foot frame 276 further comprises two legs 296, each leg 296 being connected to one of the side frame members 292. In particular a first end 295 of each leg 296 is connected to a respective side frame member 292 proximate the cross member 294. In a deployed configuration the legs 296 extend substantially perpendicularly from the side frame members 292. An angle between the legs 296 and the side frame members 292 may be between 90° and 130°. A second end 293 of each of the side frame members 292 is connectable to the first end 218 of a respective main frame member 216.

To allow a person to lie on the bed 272, in this embodiment the flexible support 240 comprises a central portion 298, a foot portion 300 and a head portion 302. The central portion 298 is attached to the main frame members 216 along opposite side edges. The foot portion 300 extends from a first end edge 297 of the central portion 298 and the head portion 302 extends from an opposite second end edge 299 of the central portion 298. With the convertible frame 210 in the second configuration and the foot frame 276 and back frame 274 connected to the convertible frame 210, the foot portion 300 of the flexible support 240 may be attached to one or all of the side frame members 292 and cross member 294 so as to extend over the foot frame 276, and the head portion 302 of the flexible support 240 may be attached to one or all of the side frame members 278 and head frame member 280 so as to extend over the back frame 274.

In this embodiment the foot portion 300 of the flexible support 240 comprises an elastic strap or section 332 adjacent or at a free end edge 334 of the foot portion 300 of the flexible support 240. The elastic section 332 may be in the form of a sleeve within which at least a part of the foot frame 276 is received. To partially attach the foot portion 300 of the flexible support 240 to the foot frame 276 the elastic strap or section 332 is stretched over the cross member 294 of the foot frame 276. Similarly, in this embodiment the head portion 302 of the flexible support 240 comprises an elastic strap or section 336 adjacent or at a free end edge 338 of the head portion 302 of the flexible support 240. The elastic section 336 may be in the form of a sleeve within which at least a part of the back frame 274 is received. To partially attach the head portion 302 of the flexible support 240 to the back frame 274 the elastic strap or section 338 is stretched over the head frame member 280 of the back frame 274.

In preferred embodiments the foot portion 300 of the flexible support 240 further comprises one or more securement members or clips 340 to secure each side edge 342 of the foot portion 300 to a respective one of the two side frame members 292 of the foot frame 276. Similarly, the head portion 302 of the flexible support 240 further comprises one or more securement members or clips 340 to secure each side edge 344 of the head portion 302 to a respective one of the two side frame members 278 of the back frame 274.

The clips may be of any suitable design or configuration that allows the foot portion 300 and head portion 302 of the flexible support 240 to be easily and repeatedly attached to and removed from the foot frame 276 and back frame 274 respectively. In a preferred embodiment, and as shown in FIGS. 18, 19*a* and 19*b*, each of the clips 340 may comprise an elongate channel 346 configured to engage with a respective one of the side frame members 292, 278. In this embodiment the clip 340 comprises an elongate hollow tubular element 348 extending between first and second ends 350, 352. A longitudinal slit or gap 354 is provided in the tubular element 348, the slit 354 extending fully along the length of the tubular element 348 between the first and second ends 350, 352.

A diameter of a bore 356 of the tubular element 348 is preferably slightly larger than or substantially the same as an outer diameter of the side frame member 292, 278. In some embodiments, however, the diameter of the bore 356 may be slightly smaller than the outer diameter of the side frame member 292, 278. A width of the slit 354, defined between side edges 358, is substantially smaller than the outer diameter of the side frame member 292, 278. The tubular element 348 is resilient such that, in use, when the tubular element 348 is pressed against the side frame member 292, 278, with the side edge 358 in contact with the side frame member 292, 278, the side edges 358 are pushed apart so that the tubular element 348 can be pressed over the side frame member 292, 278 until the side frame member 292, 278 is received in the bore 356 of the tubular element 348 (as indicated by the dashed lines in FIG. 19*a*).

In preferred embodiments the tubular element 348 includes a pair of flanges 347, 349. Each flange 347, 349 extends longitudinally along the tubular element 348. Each flange 347, 349 extends radially outwards from an outer surface of the tubular element 348. The flanges 347, 349 preferably extend from diametrically opposite sections of the tubular element 348. One of the side edges 342, 344 of the foot portion 300 or head portion 302 is attached to a first one of the flanges 347 and a second one of the flanges 349 provides a handle or grip element to aid a user when removing the clip 340 from the side frame member 292, 278.

In other embodiments, in place of or in addition to the clips 340, the foot portion 300 and the head portion 302 of the flexible support 240 may comprise one or more straps 359 or other similar fasteners to secure each of the side edges 342 of the foot portion 300 to a respective one of the two side frame members 292 of the foot frame 276 and each of the side edges 344 of the head portion 302 to a respective one of the two side frame members 278 of the back frame 274.

In preferred embodiments the central portion 298, foot portion 300 and head portion 302 of the flexible support 240 are integrally formed. As such, in these embodiments, when the frame 210 is converted into the first configuration, the complete flexible support 240, including the central portion 298, foot portion 300 and head portion 302, is disposed between the rear wall portion 250 and the rear flap 256 of the rucksack 212.

To enable the complete bed 272 to be carried in the rucksack 212, the foot frame 276 and back frame 274 are preferably convertible into a folded configuration. The struts 282 of the back frame 274 may be pivotally connected to the side frame members 278 so that the struts 282 can be folded into a position in which they extend at least substantially parallel to the side frame members 278. Similarly, the legs 296 of the foot frame 276 are preferably pivotally connected to the side frame members 292 so that the legs 296 can be folded into a position in which they extend parallel to the side frame members 292.

As described above, the distance between the main frame members 216 in the first configuration is less than the distance between the main frame members 216 in the second configuration. Accordingly, to enable the foot frame 276 and the back frame 274 to be accommodated in the rucksack 212, it may also be necessary to decrease a distance between the side frame members 292 of the foot frame 276 and the side frame members 278 of the back frame 274. In some embodiments each of the head frame member and the cross member may be formed in two parts which are slidably connected to allow a distance between the respective side frame members 278, 292 to be altered. The head frame member and the cross member may be telescopic, or may include an extendable connector.

In preferred embodiments the foot frame 276 comprises two separable frame elements 277, each of the separable frame elements 277 comprising one of the side frame members 292 and a part of the cross member 294. Similarly, the back frame 274 preferably comprises two separable frame elements 275, each of the separable frame elements 275 comprising one of the side frame members 278 and a part of the head frame member 280. In this way, each of the separable frame elements 275, 277 is substantially L-shaped. All four separable frame elements 275, 277 can be stowed separately in the rucksack 212, for example as shown in FIGS. 14, 16 and 17.

The convertible frame 210 preferably includes a latching mechanism to allow the frame 210 to be latched in the first configuration and/or the second configuration. In some embodiments the extendable connectors 222 comprise tubular members and the latching mechanism comprises a biased member or retractable pin 360 attached to one of the tubular members and a hole 362 or a series of holes in the other one of the tubular members. The retractable pin 360 is biased to locate in the hole 362 or one of the holes to retain the tubular members in a fixed position with respect to each other. In some embodiments, the pin may locate in a first one of the holes with the extendable connector in the retracted configuration and in a second one of the holes with the extendable connector in the extended configuration. To allow relative movement of the tubular members between the retracted and extended configurations, the pin 360 can be pressed or retracted to release the pin 360 from the hole 362 such that the tubular members can be slid relative to each other until the pin 360 locates in the other one of the holes 362. In preferred embodiments the latching mechanism is provided in or on the second pair of extendable connectors 222*b*.

Similarly, each of the back frame 274 and foot frame 276 may include a latching mechanism. In particular, in embodiments in which each of the back frame 274 and foot frame 276 includes two separable frame elements 275, 277, the latching mechanism is configured to latch the separable frame elements 275, 277 together such that the side frame members 292 of the foot frame 276 are in the correct orientation with respect to each other, the side frame members 278 of the back frame 274 are in the correct orientation with respect to each other, and there is the correct distance between each of the foot frame side frame members 292 and each of the back frame side frame members 278, to allow the foot frame 276 and back frame 274 to be connected to the convertible frame 210 in the second configuration.

In preferred embodiments the cross member 294 and the head frame member 280 are telescopic and comprise hollow tubular members. In these embodiments the latching mechanism of the foot frame 276 may comprise a retractable pin 360 attached to a first part of the cross member 294 and a hole 362 in a second part of the cross member 294. Similarly, the latching mechanism of the back frame 274 may comprise a retractable pin 360 attached to a first part of the head frame member 280 and a hole 362 in a second part of the head frame member 280. The retractable pin 360 is biased to locate in the hole 362 when the separable frame elements are joined together. To allow the separable frame elements to be separated, the pin 360 can be pressed or retracted to release the pin 360 from the hole 362 such that the tubular members can be slid relative to each other to withdraw one of the tubular members from the other of the tubular members.

In other preferred embodiments the latching mechanisms of the foot frame 276 and back frame 274 comprise a bayonet-style latching mechanism in which a pin is engageable with a slot. Preferably the slot is L-shaped having a first section extending substantially parallel to the longitudinal axis of the cross member 294 or head frame member 280 and a second section extending transverse to the longitudinal axis of the cross member 294 or head frame member 280.

The separated and individual separable frame elements 275, 277 can be stowed in the rucksack 212 within a region defined by the frame 210, as shown most clearly in FIG. 14. Preferably one end of each of the separable frame elements 275, 277 is retained in a pocket or sleeve attached to the rear wall portion 250 of the bag 242. A strap or loop may be provided to secure a region of the separable frame elements 275, 277 proximate a second end of the separable frame elements 275, 277 to the rear wall portion 250 of the bag 242.

The advantage of connecting the bag 242 to the convertible frame 210 as described above is that the bag 242 may be attached to and removed from the frame 210 without having to remove the contents from the bag 242. In one particular embodiment of a rucksack 412, shown in FIGS.

20 to 25, the bag 442 further comprises two access flaps 470 in the front wall portion 452 of the bag 442 to permit access to the interior volume of the bag 442. These flaps 470 allow access to the interior volume both when the bag 442 is connected to the convertible frame 210 and when the bag 442 has been separated from the convertible frame 210. In preferred embodiments the interior volume of the bag 442 is divided into two sections. An upper section 564 of the interior volume is accessed through an upper one of the access flaps 470 and a lower section 566 of the interior volume is accessed through a lower one of the access flaps 470. In other embodiments the interior volume may not be divided into two sections; however, two access flaps may still be provided. Alternatively the bag may only include a single access flap in the front wall portion of the bag.

In this embodiment the rucksack 412 further comprises two side pockets 568 connected to each of the side wall portions 448 of the bag 442. The side pockets 568 may be of any suitable design. Each of the side pockets 568 has an internal volume and in preferred embodiments, when the internal volume is filled with contents, the internal volume of the side pocket 568 extends into the interior volume of the bag 442.

Figure 23:
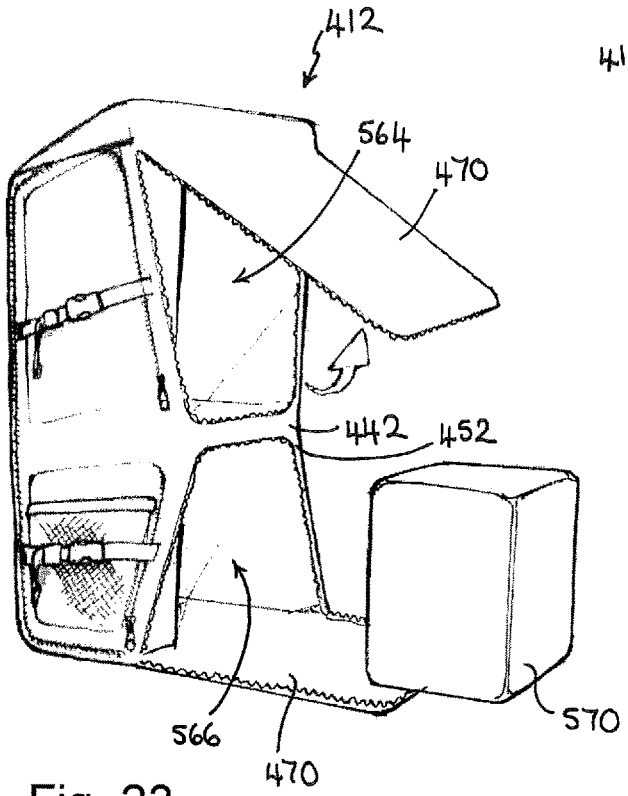
FIG. 23 is a perspective view of the rucksack of FIG. 20 showing front pockets of the rucksack in an open configuration, and with a storage pod removed from a lower one of the front pockets.
Figure 24:
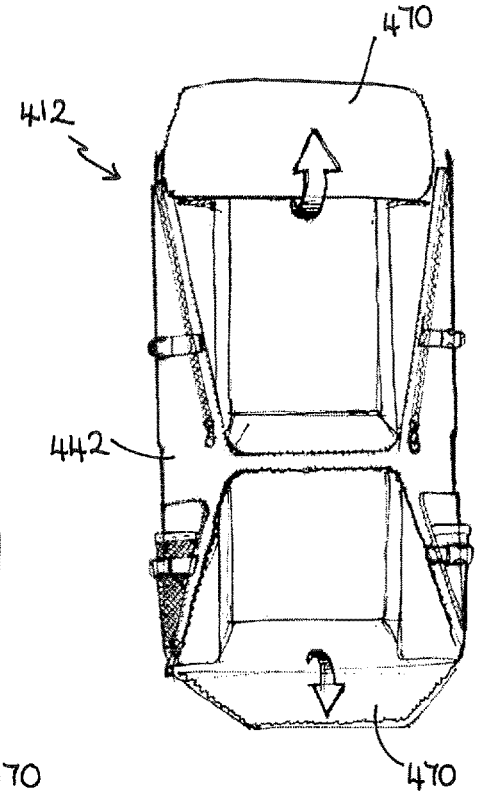
FIG. 24 is a front view of the rucksack of FIG. 20 showing front pockets of the rucksack in an open configuration.

As shown in FIG. 23, the bag 442 further comprises an interchangeable pod or inner bag 570. The pod 570 may have a specific primary function, for example the pod 570 may be padded for carrying a camera or may be insulated for transporting food and drink. In this embodiment the pod is sized to be receivable within the lower section 566 of the interior volume of the bag 442.

Figure 25:
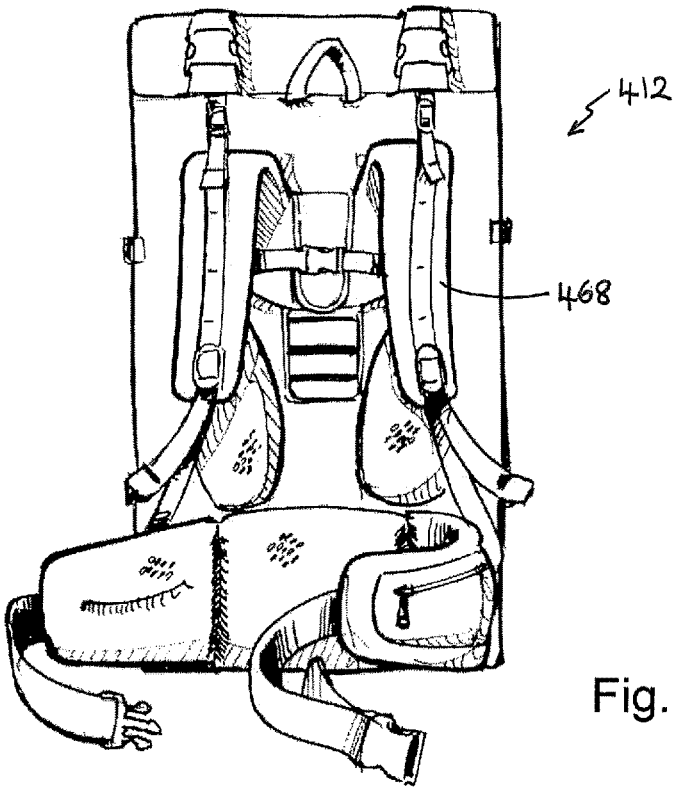
FIG. 25 is a rear view of the rucksack of FIG. 20.

To make the rucksack 412 comfortable to carry, the rucksack 412 preferably includes padded shoulder straps 468 and a padded waist strap. As shown in FIG. 25, the rucksack 412 preferably also includes a sternum strap extending between the two shoulder straps 468. It will be appreciated that all of the straps are preferably adjustable as is known in the art.

The present invention therefore provides a support for a person, such as a chair or bed, that is more easily transported to a place of use. In particular the support provides a frame for, and therefore may be carried as part of, a rucksack.

The invention claimed is:

1. A rucksack comprising:

a convertible frame comprising:

two main frame members connected together by a pair of extendable connectors;

at least two leg members connected or connectable to the main frame members; and a flexible support attached or attachable to the main frame members to extend between the main frame members, the frame being convertible between a first configuration in which the frame is housed within the rucksack and there is a first distance between the main frame members, and a second configuration in which the frame forms a support for a person and there is a second distance between the main frame members, the second distance being larger than the first distance;

a bag attached to the convertible frame, the bag having a base panel, a top panel, side wall panels, a rear wall panel and a front wall panel, said panels defining an internal volume of the bag;

a rear cover extending over the rear wall panel of the bag such that at least a part of the convertible frame and at least a part of the flexible support are disposed between the rear panel of the bag and the rear cover, a first side edge of the rear cover being adjacent a first side edge of the rear wall panel of the bag and a second side edge of the rear cover being adjacent a second side edge of the rear wall panel of the bag; and shoulder straps connected to the rear cover, wherein the rear cover comprises an upper portion that extends over the top panel of the bag, and a part of the convertible frame is disposed between the upper portion of the rear cover and the top panel of the bag.

2. The rucksack as claimed in claim 1, wherein the rear cover comprises a lower portion that extends over the base panel of the bag, and a part of the convertible frame is disposed between the lower portion of the rear cover and the base panel of the bag.

3. The rucksack as claimed in claim 2, wherein the convertible frame is fully covered by the rear cover.

4. The rucksack as claimed in claim 1, further comprising a first fastener connecting the first side edge of the rear cover to a part of the bag adjacent the first side edge of the rear wall panel and a second fastener connecting the second side edge of the rear cover to a part of the bag adjacent the second side edge of the rear wall panel.

5. The rucksack as claimed in claim 1, wherein the first distance between the main frame members defines a width of the rucksack.

6. The rucksack as claimed in claim 5, wherein the first distance between the main frame members is between 400 mm and 500 mm.

7. The rucksack as claimed in claim 6, wherein the second distance between the main frame members is between 600 mm and 700 mm.

8. The rucksack as claimed in claim 1, wherein each of the extendable connectors comprises a pair of members that are slidably engaged with each other.

9. The rucksack as claimed in claim 1, wherein the flexible support comprises a sheet of fabric, a polymeric sheet, or a plurality of flexible strips.

10. The rucksack as claimed in claim 1, further comprising a latching mechanism configured to latch the convertible frame in one or both of the first configuration and the second configuration.

11. A rucksack comprising:

a convertible frame comprising:

two main frame members connected together by a pair of extendable connectors;

at least two leg members connected or connectable to the main frame members; and a flexible support attached or attachable to the main frame members to extend between the main frame members, the frame being convertible between a first configuration in which the frame is housed within the rucksack and there is a first distance between the main frame members, and a second configuration in which the frame forms a support for a person and there is a second distance between the main frame members, the second distance being larger than the first distance;

a bag attached to the convertible frame, the bag having a base panel, a top panel, side wall panels, a rear wall panel and a front wall panel, said panels defining an internal volume of the bag;

a rear cover extending over the rear wall panel of the bag such that at least a part of the convertible frame and at least a part of the flexible support are disposed between the rear panel of the bag and the rear cover, a first side edge of the rear cover being adjacent a first side edge of the rear wall panel of the bag and a second side edge of the rear cover being adjacent a second side edge of the rear wall panel of the bag; and shoulder straps connected to the rear cover, wherein the convertible frame further comprises:

a foot frame connected or connectable to a first end of each of the main frame members, the foot frame comprising a pair of foot side frame members and a pair of legs; and a back frame connected or connectable to a second end of each of the main frame members, the back frame comprising a pair of back side frame members and a pair of struts, the struts supporting the back side frame members at an angle to the main frame members when the convertible frame is in the second configuration, wherein the flexible support comprises a central portion that extends between the main frame members, a head portion configured to extend between the head side frame members and a foot portion configured to extend between the foot side frame members.

12. The rucksack as claimed in claim 11, wherein the head portion of the flexible support includes clips for securing the head portion to the back side frame members and the foot portion of the flexible support includes clips for securing the foot portion to the foot side frame members, and wherein each of the clips comprises an elongate resilient tubular member.

13. A rucksack comprising:

a convertible frame comprising:

two main frame members connected together by a pair of extendable connectors;

at least two leg members connected or connectable to the main frame members; and a flexible support attached or attachable to the main frame members to extend between the main frame members, the frame being convertible between a first configuration in which the frame is housed within the rucksack and there is a first distance between the main frame members, and a second configuration in which the frame forms a support for a person and there is a second distance between the main frame members, the second distance being larger than the first distance;

a bag attached to the convertible frame, the bag having a base panel, a top panel, side wall panels, a rear wall panel and a front wall panel, said panels defining an internal volume of the bag;

a rear cover extending over the rear wall panel of the bag such that at least a part of the convertible frame and at least a part of the flexible support are disposed between the rear panel of the bag and the rear cover, a first side edge of the rear cover being adjacent a first side edge of the rear wall panel of the bag and a second side edge of the rear cover being adjacent a second side edge of the rear wall panel of the bag;

shoulder straps connected to the rear cover; and a top cover connected to an upper region of the front wall panel of the bag and arranged to extend over an upper end edge of the rear cover.

14. The rucksack as claimed in claim 13, wherein the top cover comprises a fastener arranged to secure the top cover to the rear cover.

15. The rucksack as claimed in claim 1, further comprising a top cover connected to an upper region of the front wall panel of the bag and arranged to extend over an end edge of the upper portion of the rear cover, the top cover comprising a first side panel that extends over at least a part of a first side edge of the upper portion of the rear cover and a second side panel that extends over at least a part of a second side edge of the upper portion of the rear cover.

16. The rucksack as claimed in claim 1, further comprising straps or clips provided on the rear wall panel of the bag for securing all or part of the convertible frame to the bag.

17. A rucksack comprising:

a convertible frame comprising:

two main frame members connected together by a pair of extendable connectors;

at least two leg members connected or connectable to the main frame members; and a flexible support attached or attachable to the main frame members to extend between the main frame members, the frame being convertible between a first configuration in which the frame is housed within the rucksack and there is a first distance between the main frame members, and a second configuration in which the frame forms a support for a person and there is a second distance between the main frame members, the second distance being larger than the first distance;

a bag attached to the convertible frame, the bag having a base panel, a top panel, side wall panels, a rear wall panel and a front wall panel, said panels defining an internal volume of the bag;

a rear cover extending over the rear wall panel of the bag such that at least a part of the convertible frame and at least a part of the flexible support are disposed between the rear panel of the bag and the rear cover, a first side edge of the rear cover being adjacent a first side edge of the rear wall panel of the bag and a second side edge of the rear cover being adjacent a second side edge of the rear wall panel of the bag; and shoulder straps connected to the rear cover, wherein the internal volume of the bag is substantially disposed within a space defined by the convertible frame in the first configuration.

18. The rucksack as claimed in claim 2, wherein a first one of the at least two leg members is disposed between the lower portion of the rear cover and the base panel of the bag, a second one of the at least two leg members is disposed between the upper portion of the rear cover and the top panel of the bag, and the main frame members and the flexible support are disposed between the rear panel of the bag and a main portion of the rear cover.

* * * * *